US011280466B2

(12) United States Patent
Tanaka et al.

(10) Patent No.: US 11,280,466 B2
(45) Date of Patent: Mar. 22, 2022

(54) OPTICAL UNIT AND METHOD FOR DETERMINING REFLECTION PLANE

(71) Applicant: Koito Manufacturing Co., Ltd., Tokyo (JP)

(72) Inventors: Hidetada Tanaka, Shizuoka (JP); Kazutoshi Sakurai, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/354,366

(22) Filed: Jun. 22, 2021

(65) Prior Publication Data

US 2021/0310630 A1 Oct. 7, 2021

Related U.S. Application Data

(63) Continuation of application No. PCT/JP2019/049021, filed on Dec. 13, 2019.

(30) Foreign Application Priority Data

Dec. 25, 2018 (JP) ..... JP2018-241020
Dec. 25, 2018 (JP) ..... JP2018-241021
(Continued)

(51) Int. Cl.
*F21S 41/675* (2018.01)
*F21S 41/33* (2018.01)
(Continued)

(52) U.S. Cl.
CPC ..... *F21S 41/675* (2018.01); *F21S 41/148* (2018.01); *F21S 41/25* (2018.01); *F21S 41/33* (2018.01); *F21S 41/37* (2018.01)

(58) Field of Classification Search
None
See application file for complete search history.

(56) References Cited

U.S. PATENT DOCUMENTS 5,008,781 A 4/1991 Nino
2012/0287651 A1 11/2012 Hirata
(Continued)

FOREIGN PATENT DOCUMENTS

JP H02-129803 A 5/1990
JP 2008-204915 A 9/2008
(Continued)

OTHER PUBLICATIONS

International Search Report (Form PCT/ISA/210) dated Mar. 3, 2020, in corresponding International Application No. PCT/JP2019/049021. (12 pages).
(Continued)

*Primary Examiner* — Elmito Breval
(74) *Attorney, Agent, or Firm* — Buchanan Ingersoll & Rooney PC

(57) ABSTRACT

An optical unit includes: a light source; a rotating reflector configured to be rotated in a single direction with the rotational axis as the center of rotation while reflecting light emitted from the light source; and a projector lens configured to project light reflected by the rotating reflector in the light irradiation direction. The projector lens has a first lens region LR1 that defines the first focal plane and a second lens region that defines the second focal plane that differs from the first focal plane. The light source is arranged such that, when the rotating reflector is set to the first rotational position, its virtual position is in the vicinity of the focal plane, and such that, when the rotating reflector is set to the second rotational position, its virtual position is in the vicinity of the focal plane.

15 Claims, 21 Drawing Sheets

(30) Foreign Application Priority Data

Dec. 25, 2018 (JP) ..... JP2018-241022
Dec. 25, 2018 (JP) ..... JP2018-241023

(51) Int. Cl.
*F21S 41/25* (2018.01)
*F21S 41/37* (2018.01)
*F21S 41/148* (2018.01)

(56) References Cited

U.S. PATENT DOCUMENTS

| | | | |
|---|---|---|---|
| 2013/0038736 | A1 | 2/2013 | Yamamura |
| 2014/0313755 | A1 | 10/2014 | Tanaka |
| 2016/0161074 | A1 | 6/2016 | Yagi et al. |
| 2016/0341388 | A1 | 11/2016 | Tanaka et al. |
| 2017/0158113 | A1 | 6/2017 | Kanayama et al. |
| 2017/0185855 | A1 | 6/2017 | Yamamura |

FOREIGN PATENT DOCUMENTS

| | | | |
|---|---|---|---|
| JP | 2013-020746 | A | 1/2013 |
| JP | 2014-216049 | A | 11/2014 |
| JP | 2016-058547 | A | 4/2016 |
| JP | 2016-110760 | A | 6/2016 |
| JP | 2017-103189 | A | 6/2017 |
| JP | 2017-126433 | A | 7/2017 |
| JP | 2018-166119 | A | 10/2018 |
| WO | 2011/129105 | A1 | 10/2011 |
| WO | 2015/122304 | A1 | 8/2015 |

OTHER PUBLICATIONS

International Preliminary Report on Patentability (Form PCT/IB/373) and the Written Opinion of the International Searching Authority (Form PCT/ISA/237) dated Jun. 16, 2021, in corresponding International Application No. PCT/JP2019/049021. (25 pages).

10

22(22R)

18

22

22

18

18

OPTICAL UNIT AND METHOD FOR DETERMINING REFLECTION PLANE

BACKGROUND

1. Technical Field

The present invention relates to an optical unit that is applicable to a lamp such as an automotive lamp or the like. Also, the present invention relates to a method for determining a reflective face of a rotating reflector or the like.

2. Description of the Related Art (1) (2) In recent years, an apparatus has been proposed configured to reflect light emitted from a light source toward an area in front of a vehicle, and to scan the area in front of the vehicle using the reflected light thereof, so as to form a predetermined light distribution pattern. For example, such an apparatus includes a rotating reflector configured to rotate in a single direction with its rotational axis as the center of rotation while reflecting the light emitted from the light source, and a light source configured as a light-emitting element. The rotating reflector is provided with a reflective face such that the light emitted from the light source is reflected by the rotating reflector while it rotates and such that the light thus reflected forms a desired light distribution pattern. Furthermore, the light emitted from the light source and reflected by the reflective face is projected as a light source image toward the side in front of the vehicle via a projection lens (see Patent documents 1 and 3).

(3) As described above, such an automotive lamp is configured employing various kinds of optical components such as a lens, reflector, etc. Such an optical component is designed having a suitable reflective face or refractive face so as to satisfy the optical performance of the lamp to be employed.

For example, a design method has been proposed for designing a reflecting mirror to be employed in a headlamp. That is to say, the reflective face is divided into an upper region and a lower region, and is further divided into a left region and a right region. The left and right reflective faces are each designed as a curved face having a vertical cross section and a horizontal cross section each represented by a quadratic curve having a focal point. The light source position at which the light source is to be mounted is designed such that it is shifted in the frontward direction from the focal point toward the reflective face side. Furthermore, the reflecting mirror is designed such that the left and right reflective faces have the same light source mounting position. Moreover, the reflecting mirror is designed such that the left-side reflective face has an optical axis tilted toward the left and the right-side reflective face has an optical axis tilted toward the right (see Patent document 2).

Patent Document 1: International Publication WO 11/129105

Patent document 2: Japanese Patent Application Laid Open No. H02-129803

Patent Document 3: International Publication WO 15/122304

(1) However, the blade of the rotating reflector described above has a twisted shape such that the angle defined between the optical axis and the reflective face is changed along the circumferential direction with the rotational axis as the center. Accordingly, such an arrangement has the potential to cause a situation in which a light source image cannot be clearly projected depending on the direction in which the light emitted from the light source is reflected by the blade.

(2) The above-described apparatus has the potential to cause a situation in which the light distribution pattern cannot be formed in a rectangular shape depending on the position relation between the rotating reflector, the light source, and the projector lens.

(3) The rotating reflector described above is formed to have a non-flat reflective face. Furthermore, the angle of the reflective face at which the light emitted from the light source is reflected changes in a periodic manner Accordingly, a new method for determining the reflective face is required.

(4) The above-described apparatus has the potential to cause a problem in that, when sunlight is input to the apparatus via the projector lens in the daytime, in some cases, the sunlight thus input is focused on a particular component in the apparatus, leading to damage of the component due to melting. In order to solve such a problem, the above-described apparatus is provided with a shade between the projector lens and the rotating reflector in order to prevent sunlight from focusing on the blade surface of the rotating reflector.

However, the above-described shade is fixedly mounted. Accordingly, in order to reflect the light emitted from the light source toward the projector lens so as to form a desired light distribution pattern, the shade is required to be configured so as to exposure a region on the reflective face of the blade. That is to say, a portion of the shade is opened. With such an arrangement, if the light emitted from the light source is reflected by a portion that corresponds to the rotating shaft instead of the blade, for example, such an arrangement has the potential to cause glare due to the reflected light.

SUMMARY OF THE INVENTION

The present invention has been made in view of such a situation. (1) It is an exemplary purpose of the present invention to provide a technique to allow an optical unit including a rotating reflector to provide a clear light distribution pattern.

(2) Also, it is another exemplary purpose of the present invention to provide a novel technique for providing a light distribution pattern that is closer to a desired shape.

(3) Also, it is yet another exemplary purpose of the present invention to provide a novel technique for determining the shape of the reflective face of the rotating reflector.

(4) Also, it is yet another exemplary purpose of the present invention to provide a technique for suppressing glare that occurs due to the reflection of the light emitted from the light source by a portion that differs from a predetermined reflective region of the rotating reflector.

(1) An optical unit according to an embodiment of the present invention includes: a light source; a rotating reflector structured to be rotated in a single direction with a rotational axis as a center of rotation while reflecting light emitted from the light source; and a projector lens structured to project the light reflected by the rotating reflector in a light irradiation direction. The projector lens includes a first lens region structured to define a first focal plane and a second lens region structured to define a second focal plane that differs from the first focal plane. The light source is arranged such that, when the rotating reflector is set to a first rotational position, a virtual image position of the light source is positioned in the vicinity of the first focal plane, and such that, when the rotating reflector is set to a second rotational position, a virtual image position of the light source is positioned in the vicinity of the second focal plane.

(2) An optical unit according to an embodiment of the present invention includes: a light source; a rotating reflector structured to be rotated in a single direction with a rotational axis as a center of rotation while reflecting light emitted from the light source; and a projector lens structured to project the light reflected by the rotating reflector in a light irradiation direction. The rotating reflector is provided with a reflective face around a rotational axis thereof such that light emitted from the light source and reflected by the rotating reflector while rotating is projected by means of the projector lens so as to form a desired light distribution pattern. The reflective face has a blade shape structure that is twisted such that an angle defined between the rotational axis and the reflective face is changed along a circumferential direction with the rotational axis as a center. The rotational axis is arranged with a slope with respect to the front-rear direction of the optical unit and with a shift with respect to a plane including a focal point of the projector lens.

(3) A reflective face determining method according to an embodiment of the present invention is a reflective face determining method for determining a reflective face of a rotating reflector structured to be rotated in a single direction with a rotational axis as a center of rotation while reflecting light emitted from a light source. The reflective face determining method includes: setting an optical face of a projector lens that is capable of providing a desired light distribution pattern in a front side; setting a region of a virtual light source regarded as emitting light to be projected as the light distribution pattern; setting an angle of the rotational axis of the rotating reflector with respect to a straight line that passes through a focal point of the projector lens; setting the position of the light source; setting a range of a reflection angle of the rotating reflector such that a virtual image position of the light source matches the region of the virtual light source; and setting multiple divided cross-sectional faces in the range of the reflection angle, and rotationally extending and connecting the multiple divided cross-sectional faces with the rotational axis as a center, so as to set a reflective face of the rotating reflector.

(4) An optical unit according to an embodiment of the present invention includes: a rotating reflector having a rotating portion, and a reflective face provided around the rotating portion and structured to reflect light emitted from a light source while rotating so as to form a light distribution pattern; and a shade having a central shielding portion structured to shield light that passes toward the rotating portion from among the light emitted from the light source, or to shield light reflected by the rotating portion from among the light emitted from the light source.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

Figure 1:
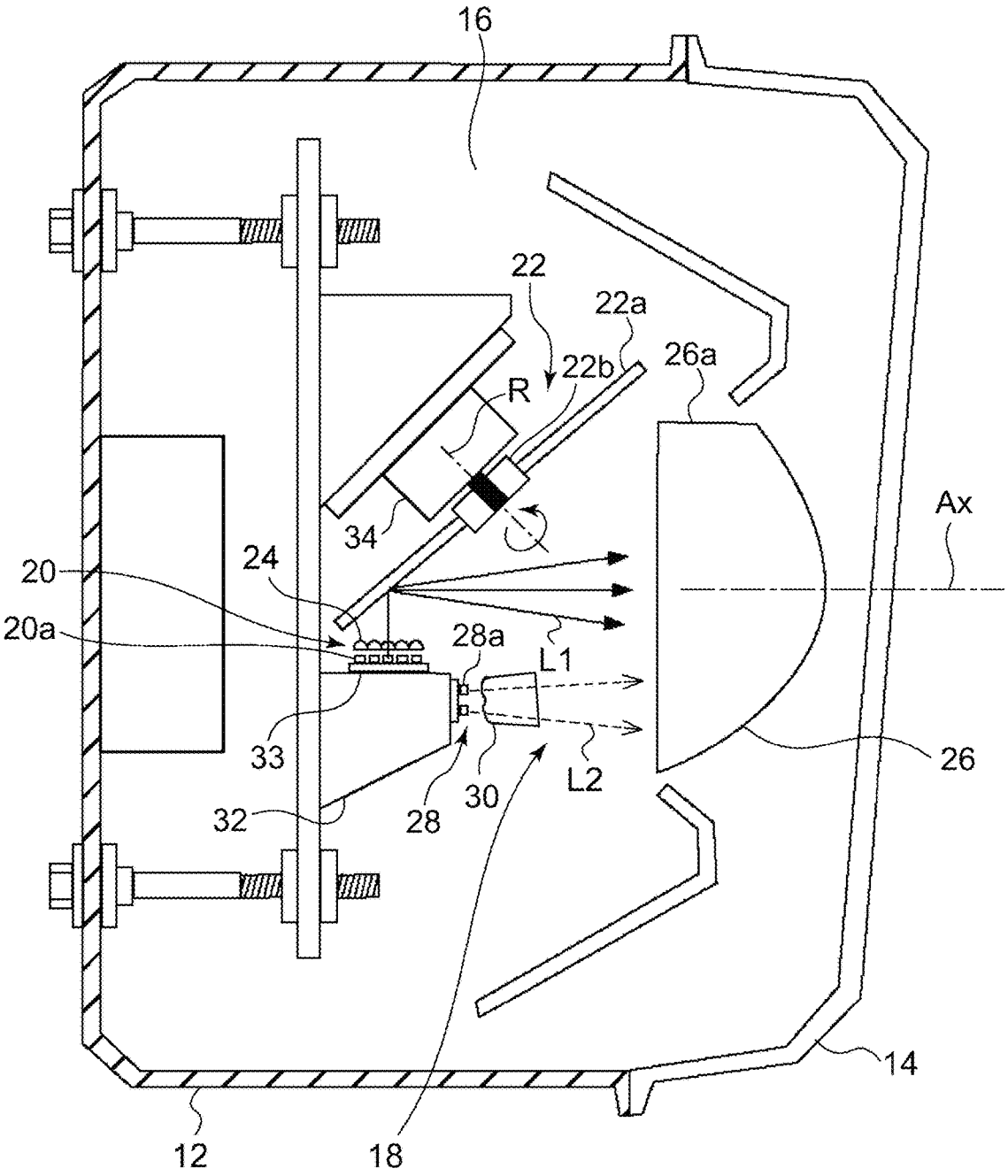
FIG. 1 is a schematic horizontal cross-sectional diagram showing an automotive headlamp according to the present embodiment.

DETAILED DESCRIPTION OF THE INVENTION (1) An optical unit according to an embodiment of the present invention includes: a light source; a rotating reflector structured to be rotated in a single direction with a rotational axis as a center of rotation while reflecting light emitted from the light source; and a projector lens structured to project the light reflected by the rotating reflector in a light irradiation direction. The projector lens includes a first lens region structured to define a first focal plane and a second lens region structured to define a second focal plane that differs from the first focal plane. The light source is arranged such that, when the rotating reflector is set to a first rotational position, a virtual image position of the light source is positioned in the vicinity of the first focal plane, and such that, when the rotating reflector is set to a second rotational position, a virtual image position of the light source is positioned in the vicinity of the second focal plane.

With this embodiment, the light emitted from the light source can be readily focused regardless of whether the rotating reflector is set to the first rotational position or the second rotational position. This provides a widened region where a clear pattern can be formed by scanning the light projected in the light irradiation direction.

Also, the first lens region may include a center of the projector lens. Also, the second lens region may be positioned on an outer side of the first lens region. This provides a region where a clear pattern can be formed, including a region where the light that has passed through the center of the projector lens is projected and an outer-side region thereof.

Also, the rotating reflector may be provided with a reflective face such that light emitted from the light source and reflected by the rotating reflector while rotating forms a desired light distribution pattern. Also, the projector lens may be structured such that the light that has passed through the first lens region is irradiated to a central portion of the light distribution pattern, and such that the light that has passed through the second lens region is irradiated to an end portion of the light distribution pattern. This allows the light distribution pattern to have a central portion and end portions that are both clear.

Also, the rotating reflector may be structured such that a blade that functions as the reflective face is provided around a rotational axis. Also, the blade may have a twisted structure in which an angle defined between an optical axis and the reflective face is changed along a circumferential direction thereof with the rotational axis as a center.

Also, the projector lens may be structured to have an input face and an output face determined such that there is no crossing within the projector lens between light beams reflected by the rotating reflector. This allows the lens plane of the projector lens to be designed easily.

(2) An optical unit according to an embodiment of the present invention includes: a light source; a rotating reflector structured to be rotated in a single direction with a rotational axis as a center of rotation while reflecting light emitted from the light source; and a projector lens structured to project the light reflected by the rotating reflector in a light irradiation direction. The rotating reflector is provided with a reflective face around a rotational axis thereof such that light emitted from the light source and reflected by the rotating reflector while rotating is projected by means of the projector lens so as to form a desired light distribution pattern. The reflective face has a blade shape structure that is twisted such that an angle defined between the rotational axis and the reflective face is changed along a circumferential direction with the rotational axis as a center. The rotational axis is arranged with a slope with respect to the front-rear direction of the optical unit and with a shift with respect to a plane including a focal point of the projector lens.

This embodiment allows the light distribution pattern to be formed in a scanning direction that is closer to the horizontal direction.

Also, the rotational axis may be arranged such that it is shifted in an upper-lower direction with respect to a plane including a focal point of the projector lens. With this, the light distribution pattern can be formed by changing a layout such that it becomes closer to a desired shape.

Also, the rotational axis may be provided approximately parallel to a scanning plane formed by continuously connecting a trajectory of an irradiation beam scanned by rotation.

Also, in the front-rear direction of the optical unit, the light source may be arranged between a front end and a rear end of a region where the rotating reflector is arranged. Also, in a direction that is orthogonal to the front-rear direction of the optical unit, the light source may be arranged between both ends of a region where the projector lens and the rotating reflector are arranged.

Also, in a direction that is orthogonal to the front-rear direction of the optical unit, the light source may be arranged within a region where a rotating reflector is arranged.

(3) A reflective face determining method according to an embodiment of the present invention is a reflective face determining method for determining a reflective face of a rotating reflector structured to be rotated in a single direction with a rotational axis as a center of rotation while reflecting light emitted from a light source. The reflective face determining method includes: setting an optical face of a projector lens that is capable of providing a desired light distribution pattern in a front side; setting a region of a virtual light source regarded as emitting light to be projected as the light distribution pattern; setting an angle of the rotational axis of the rotating reflector with respect to a straight line that passes through a focal point of the projector lens; setting the position of the light source; setting a range of a reflection angle of the rotating reflector such that a virtual image position of the light source matches the region of the virtual light source; and setting multiple divided cross-sectional faces in the range of the reflection angle, and rotationally extending and connecting the multiple divided cross-sectional faces with the rotational axis as a center, so as to set a reflective face of the rotating reflector.

This embodiment allows the shape of the reflective face of the rotating reflector to be determined so as to form a desired light distribution pattern in the front.

Also, the multiple divided cross-sectional faces may be set so as to provide reflection angles at an equal pitch. This allows the reflective face to be designed easily.

Also, the reflection angle may be set in a range from ±5° to ±10° with respect to a plane that is orthogonal to the rotational axis. This allows the light distribution pattern to be formed such that it is irradiated in a desired region in front of the vehicle.

Also, the reflective face may be set such that light emitted from the light source and reflected by the rotating reflective face forms a desired light distribution pattern.

Also, the rotating reflector may be structured such that a blade that functions as the reflective face may be provided around a rotational axis. Also, the blade may have a twisted structure such that an angle defined between the rotational axis and the reflective face is changed along a circumferential direction with the rotational axis as a center.

(4) An optical unit according to an embodiment of the present invention includes: a rotating reflector having a rotating portion, and a reflective face provided around the rotating portion and structured to reflect light emitted from a light source while rotating so as to form a light distribution pattern; and a shade having a central shielding portion structured to shield light that passes toward the rotating portion from among the light emitted from the light source, or to shield light reflected by the rotating portion from among the light emitted from the light source.

This embodiment is capable of blocking the light that passes toward the rotating portion from among the light emitted from the light source, or the light reflected by the rotating portion from among the light emitted from the light source. This allows the occurrence of glare to be reduced.

Also, the shade may have an aperture portion that allows light emitted from the light source to pass toward the reflective face, and that allows light reflected by the reflective face to pass through. This arrangement is capable of suppressing the occurrence of a missing portion in the light distribution pattern and degradation of the illuminance due to the shade thus mounted.

Also, the optical unit may further include a projector lens structured to project reflected light reflected by the rotating reflector toward a front side of a vehicle. Also, the shade may further include a reflective face shielding portion structured to shield at least a part of light that passes toward the reflective face of the rotating reflector from among external light input to the projector lens from the front side of the vehicle. This arrangement is capable of blocking external light that is input via the projector lens and that passes toward the rotating reflector.

Also, the shade may be structured as a plate-shaped member having a structure in which the central shielding portion and the reflective face shielding portion are coupled. The central shielding portion may be arranged above the rotating portion such that it is recessed toward the rotating portion as compared with the reflective face shielding portion. This arrangement suppresses a problem in that the light reflected by the reflective face of the rotating reflector is blocked by the central shielding portion.

Also, the rotating portion may be formed of the same material as that of the reflective face, or may be formed with the same surface processing as the reflective face. With this, there is no need to form the rotating portion and the reflective face with different materials or different surface processing, thereby reducing a manufacturing cost for the rotating reflector.

It should be noted that any combination of the components described above or any manifestation of the present invention may be mutually substituted between a method, apparatus, system, and so forth, which are also effective as an embodiment of the present invention.

EMBODIMENTS

Description will be made below regarding the present invention based on preferred embodiments with reference to the drawings. The same or similar components, members, and processes are denoted by the same reference numerals, and redundant description thereof will be omitted as appropriate. The embodiments have been described for exemplary purposes only, and are by no means intended to restrict the present invention. Also, it is not necessarily essential for the present invention that all the features or a combination thereof be provided as described in the embodiments.

An optical unit including a rotating reflector according to the present embodiment is applicable to various kinds of automotive lamps. First, description will be made regarding the schematic configuration of an automotive headlamp system that is capable of mounting an optical unit according to the embodiment described later.

(Automotive Headlamp)

Figure 2:
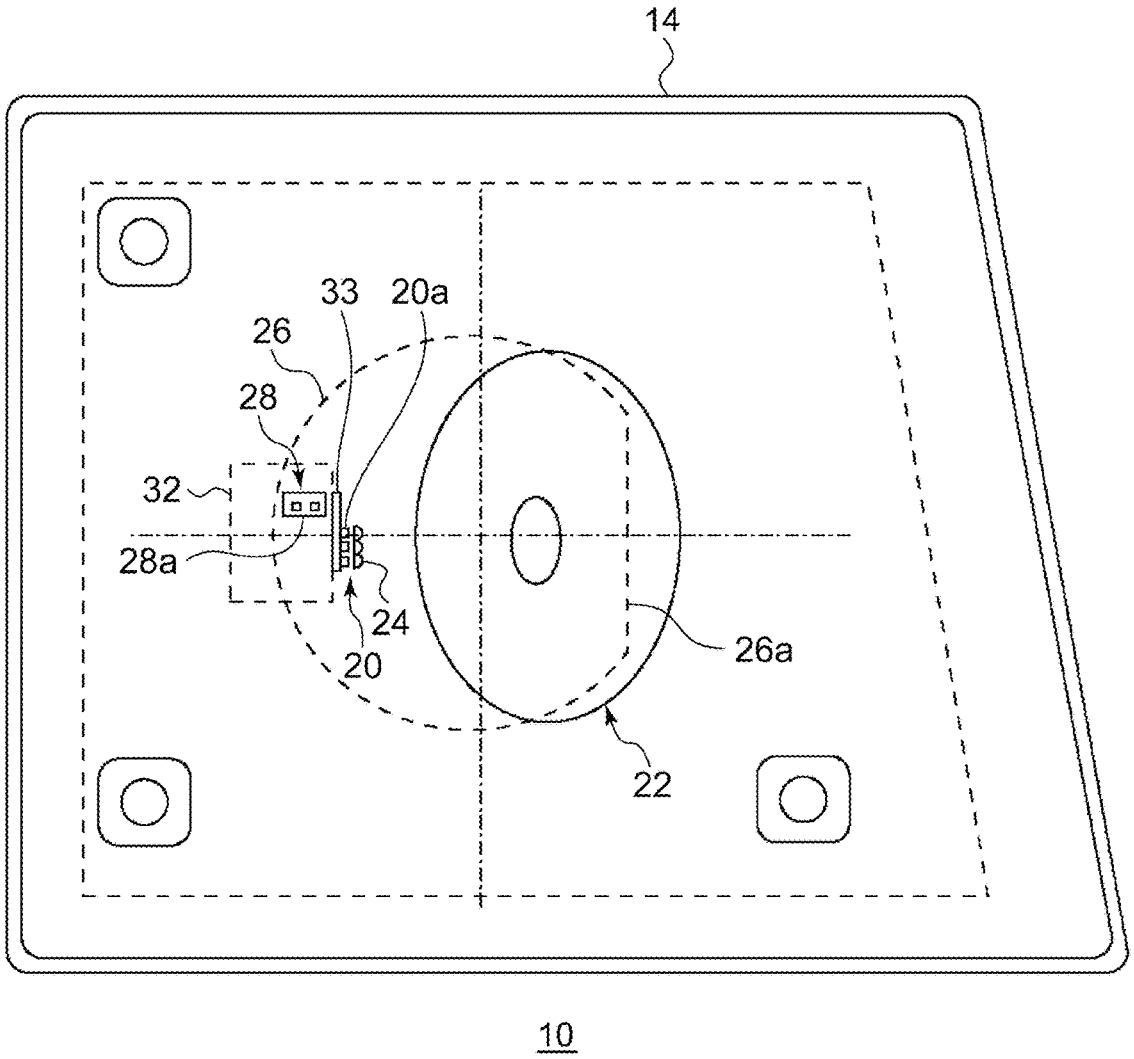
FIG. 2 is a front view of the automotive headlamp according to the present embodiment.

FIG. 1 is a horizontal cross-sectional schematic diagram showing an automotive headlamp according to the present embodiment. FIG. 2 is a front view of the automotive headlamp according to the present embodiment. It should be noted that, in FIG. 2, a part of the components are not shown.

An automotive headlamp 10 according to the present embodiment is configured as a right-side headlamp to be mounted on the right side of the front end portion of a vehicle. The automotive headlamp 10 has almost the same configuration as that of the headlamp to be mounted on the left side except that there is a left-right symmetrical relation in the layout or configuration of the main components between the left-side headlamp and the right-side headlamp. Accordingly, detailed description will be made below regarding the automotive headlamp 10 configured as a right-side automotive headlamp. Description of the left-side automotive headlamp will be omitted as appropriate.

As shown in FIG. 1, the automotive headlamp 10 includes a lamp body having a recessed portion having an opening that faces the front side. The lamp body 12 is configured such that its front-face opening is covered by a transparent front-face cover 14 so as to define a lamp chamber 16. The lamp chamber 16 functions as a space that houses a single optical unit 18. The optical unit 18 is a lamp unit configured to emit a variable high beam. The "variable high beam" represents a high beam that can be controlled such that the shape of its light distribution pattern is changed. For example, such a variable high beam allows a non-illumination region (shielded region) to be formed as a portion of the light distribution pattern. Here, the "light distribution pattern" represents an illumination region formed on a screen (virtual screen) arranged 25 to 50 m in front of the lamp, for example.

The optical unit 18 according to the present embodiment includes: a first light source 20; a condenser lens 24 configured as a primary optical system (optical member) that changes the light path of first light L1 emitted from the first light source 20 such that it is directed toward a blade 22*a* of a rotating reflector 22; the rotating reflector 22 configured such that it is rotated with the rotational axis R as the center of rotation while reflecting the first light L1; a convex lens 26 configured as a projector lens that projects the first light L1 reflected by the rotating reflector 22 in the light irradiation direction of the optical unit (rightward direction in FIG. 1); a second light source 28 arranged between the first light source 20 and the convex lens 26; a diffusing lens 30 configured as a primary optical system (optical member) that changes the light path of second light L2 emitted from the second light source 28 such that it is directed toward the convex lens 26; and a heatsink 32 mounting the first light source 20 and the second light source 28.

Each light source is configured employing a semiconductor light-emitting element such as an LED, EL, LD, or the like. The first light source 20 according to the present embodiment is configured as multiple LEDs 20*a* arranged in the form of an array on a circuit board 33. Each LED 20*a* is configured so as to allow it to be turned on and off independently.

The second light source 28 according to the present embodiment is configured as two LEDs 28*a* arranged in the form of an array in the horizontal direction. Each LED 28*a* is configured such that it can be turned on and off independently. Furthermore, the second light source 28 is arranged such that the second light L2 is input to the convex lens 26 without being reflected by the rotating reflector 22. With this, the optical characteristics of the second light L2 emitted from the second light source 28 can be selected without giving consideration to reflection thereof by the rotating reflector 22. Accordingly, by inputting the light emitted from the second light source 28 to the convex lens 26 after it is diffused by the diffusing lens 30, for example, such an arrangement allows a wider region to be illuminated. This allows the second light source 28 to be employed as a light source that illuminates the region on the outer side of the vehicle.

The rotating reflector 22 is rotated in a single direction with the rotational axis R as the center of rotation by means of a driving source such as a motor 34 or the like. Furthermore, the rotating reflector 22 is configured such that two blades 22*a* having the same shape are provided to the circumferential face of the cylindrical rotating portion 22*b*. Each blade 22*a* functions as a reflective face configured to scan the frontward side using reflected light of the light emitted from the first light source 20 while rotating, so as to form a desired light distribution pattern.

The rotating reflector 22 is arranged with its rotational axis R at an angle with respect to the optical axis Ax on a plane including the optical axis Ax and the first light source 20. In other words, the rotational axis R is defined approximately parallel to the scanning plane of the light (irradiation beam) of the LED 20*a* employed as a scanning beam to be scanned in the left-right direction by rotation. This allows the optical unit to have a thin structure. Here, the scanning plane can be regarded as a fan-shaped plane defined by continuously connecting the trajectory of the light emitted from the LED 20*a* configured as scanning light, for example.

The shape of the convex lens 26 may be preferably selected according to the light distribution characteristics such as a required light distribution pattern, illuminance distribution, or the like, as appropriate. Also, an aspherical lens or free-form surface lens may be employed. For example, by designing the layout of each light source or the rotating reflector 22 as appropriate, this arrangement allows the convex lens 26 according to the present embodiment to have a cutout portion 26*a* obtained by cutting off a part of the outer circumferential portion thereof. This allows the optical unit 18 to have a compact size in the vehicle width direction.

Also, by providing such a cutout portion 26*a*, such an arrangement reduces the potential for interference between the blades 22*a* of the rotating reflector 22 and the convex lens 26. This allows the distance between the convex lens 26 and the rotating reflector 22 to be reduced. Also, by forming a non-circular (linear) portion along the outer circumference of the convex lens 26, such an arrangement provides an automotive headlamp with an novel design, i.e., an automotive headlamp including a lens in an external form configured as a combination of a curved line and a straight line as viewed from the front side of the vehicle.

(Optical Unit)

Figure 3:
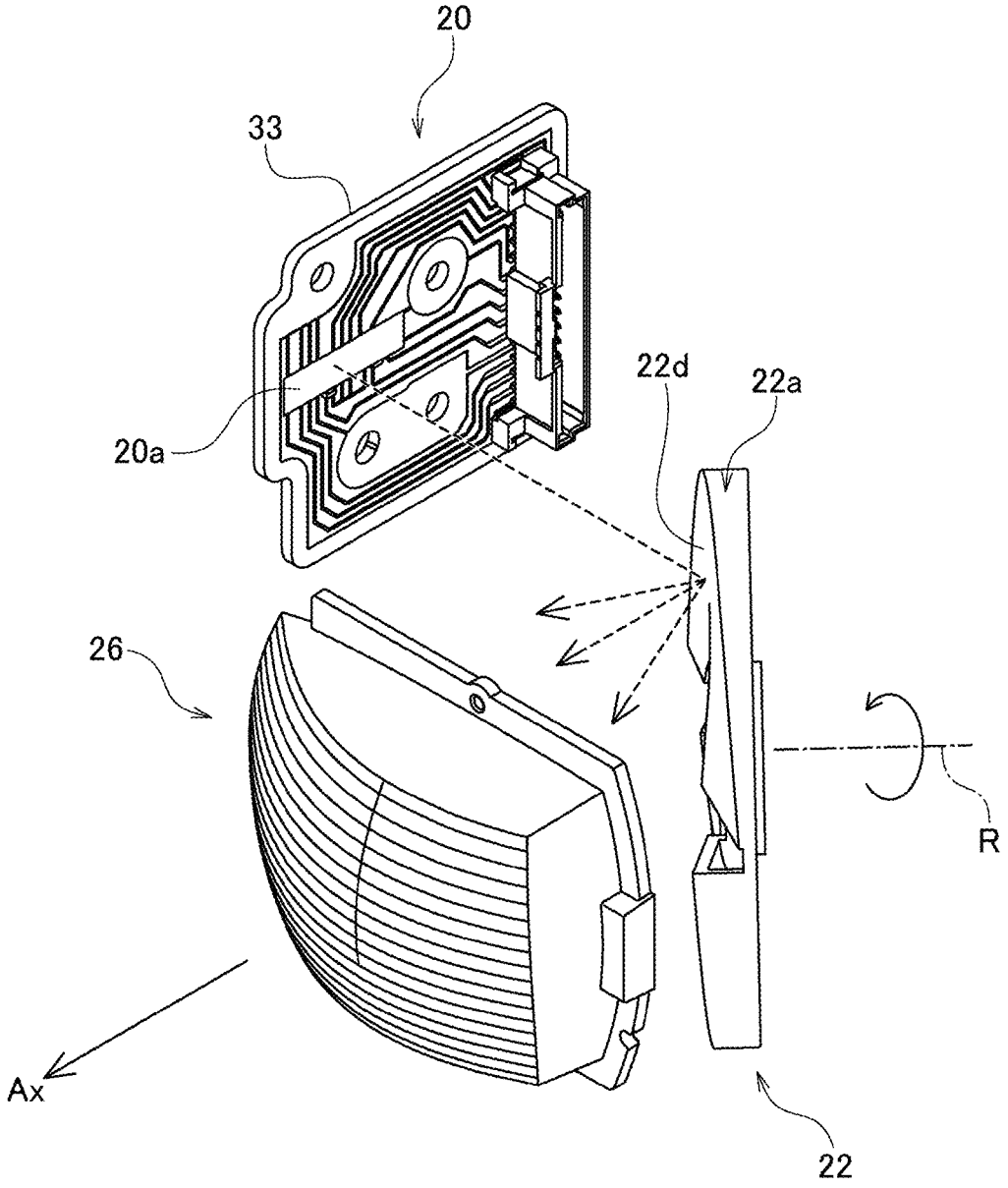
FIG. 3 is a perspective view showing main components of an optical unit according to the present embodiment.

FIG. 3 is a perspective view showing main components of the optical unit according to the present embodiment. It should be noted that, in FIG. 3, the first light source 20, the rotating reflector 22, and the convex lens 26 are shown as the main components from among the components that form the optical unit 18. For convenience of description, a part of the components is not shown.

As shown in FIG. 3, the optical unit 18 includes the first light source 20 configured as multiple LEDs 20*a* arranged in the form of a line in the horizontal direction, and the convex lens 26 configured to project the light emitted from the first light source 20 and reflected by the rotating reflector 22 in the light irradiation direction (optical axis Ax) of the optical unit. The rotating reflector 22 is arranged such that the rotational axis R extends in the horizontal direction at an inclination with respect to the light irradiation direction (optical axis Ax). Furthermore, the first light source 20 is arranged such that there is an inclination between the light-emitting face of each of the multiple LEDs 20*a* and the reflective face.

The reflective face 22*d* of each blade 22*a* has a twisted structure in which the angle between the optical axis Ax (or the rotational axis R) and the reflective face changes according to the circumferential direction with the rotational axis R as the center. It should be noted that detailed description of the reflective face structure will be made later. Here, the optical axis can be regarded as a straight line that passes through a focal point at which the light input in parallel to the lens from the front side thereof is focused, and that extends in parallel with the input light. Alternatively, the optical axis can be regarded as a straight line that passes through the thickest portion of the convex lens, and that extends in the vehicle front-rear direction on a horizontal plane. Alternatively, in a case of employing a circular lens (arc-shaped lens), the optical axis can be regarded as a straight line that passes through the center of the circle (arc), and that extends in the vehicle front-rear direction on a horizontal plane. Accordingly, it can also be said that each blade 22*a* has a twisted structure such that the angle defined between the rotational axis R and the reflective face changes along the circumferential direction thereof with the rotational axis R as the center.

(Rotating Reflector)

Figure 4:
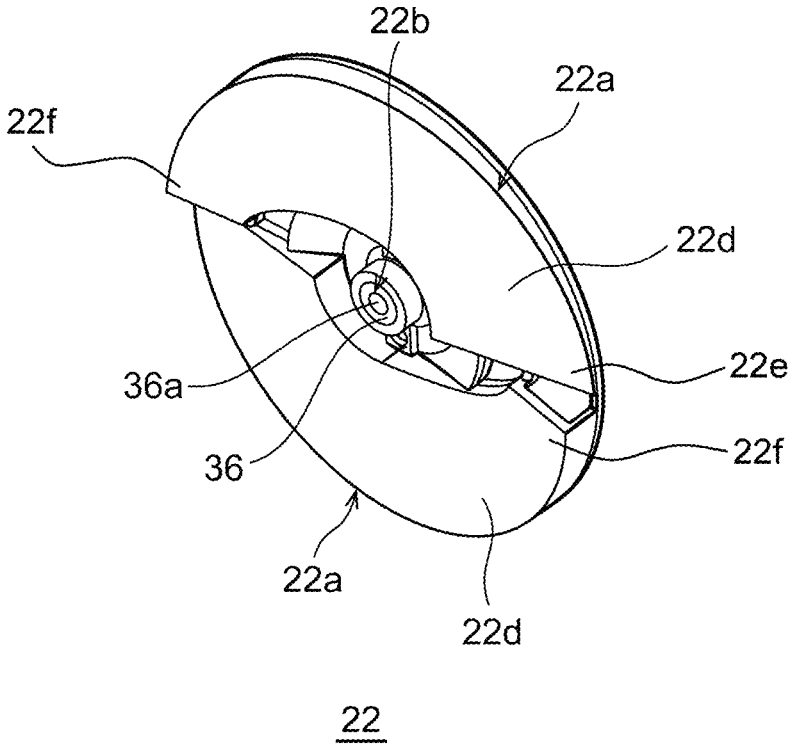
FIG. 4 is a perspective view showing a rotating reflector according to the present embodiment.
Figure 5:
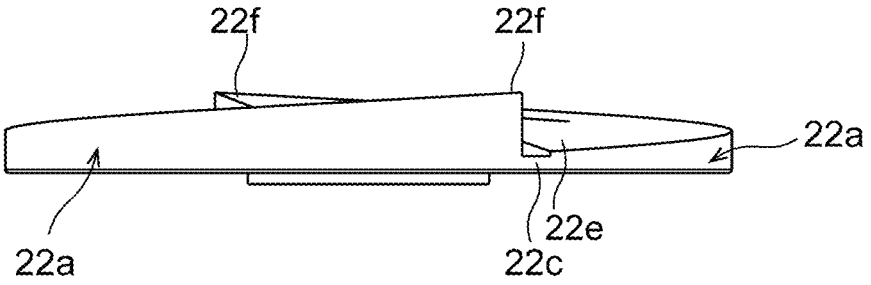
FIG. 5 is a side view of the rotating reflector according to the present embodiment.

Next, detailed description will be made regarding the structure of the rotating reflector 22 according to the present embodiment. FIG. 4 is a perspective view of the rotating reflector according to the present embodiment. FIG. 5 is a side view of the rotating reflector according to the present embodiment.

The rotating reflector 22 is configured as a component formed of a resin material including the rotating portion 22*b*, and the multiple (two) blades 22*a* arranged around the rotating portion 22*b*, and each functioning as a reflective face configured to form a light distribution pattern by reflecting the light emitted from the first light source 20 while rotating. Each blade 22*a* is configured as an arc-shaped component. The blades 22*a* are coupled adjacent to each other via their outer circumferential portions by means of a coupling portion 22*c*, so as to form a ring-shaped structure. This allows the rotating reflector 22 to be less readily subject to distortion even if the rotating reflector 22 rotates at a high speed (with a rotational speed of 50 to 240 r/s, for example).

A cylindrical sleeve 36 having an opening 36*a* through which the rotational shaft of the rotating reflector 22 is inserted and fitted is fixedly mounted at the center of the rotating portion 22*b* by insert molding. Furthermore, a ring-shaped groove 38 is formed along the outer circumferential portion of the rotating portion 22*b* such that it corresponds to the inner side of each blade 22*a*.

It should be noted that the rotating reflector 22 shown in FIGS. 4 and 5 is employed in the automotive headlamp 10 configured as a right-side headlamp. The rotating reflector 22 is rotated in a counterclockwise manner as viewed from the front side of the reflective face 22*d*. Furthermore, as shown in FIGS. 4 and 5, the reflective face 22*d* of each blade 22*a* is formed such that the height of its outer circumferential portion in the axial direction (blade thickness direction) gradually increases in the counterclockwise direction. Conversely, the reflective face 22*d* is formed such that the height in the axial direction of its inner circumferential portion that is closer to the rotating portion 22*b* gradually decreases in the counterclockwise direction.

Furthermore, the reflective face 22*d* is formed such that its height gradually increases toward the center (rotating portion 22*b*) from an end portion 22*e* of the outer circumference portion having a smaller height in the axial direction. Conversely, the reflective face 22*d* is formed such that its height gradually decreases toward the center from an end portion 22*f* of the outer circumference portion having a larger height in the axial direction.

Figure 6:
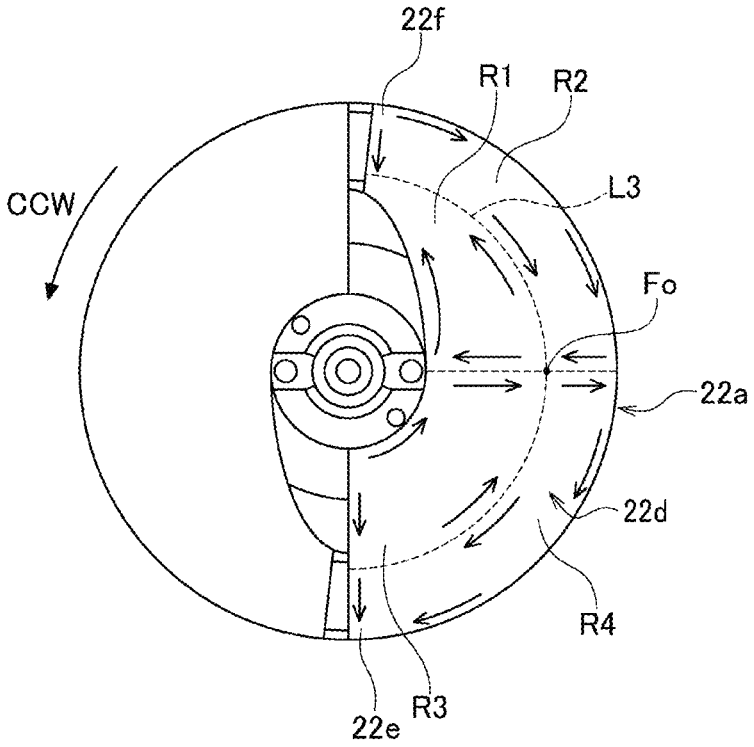
FIG. 6 is a front view of the rotating reflector to be used as a right-side headlamp for explaining the shape of the reflective face.

Description will be made regarding a normal vector defined on the reflective face 22*d* having different slope angles at different portions thereof. FIG. 6 is a front view of the rotating reflector to be employed in a right-side headlamp for explaining the structure of the reflective face. It should be noted that there is a mirror-symmetrical relation in the surface structure of the reflective face between the rotating reflector 22R to be employed in a right-side headlamp shown in FIG. 6 and an unshown rotating reflector to be employed in a left-side headlamp.

The dotted line L3 shown in FIG. 6 represents a portion of the reflective face 22*d* having an approximately constant height in the axial direction. Only the normal vector defined at the point $F_0$ on the dotted line L3 on the reflective face 22*d* is parallel to the rotational axis of the rotating reflector 22R.

Each arrow shown in FIG. 6 indicates the slope direction for a given region. Each arrow is drawn such that it indicates a direction from the side on which the reflective face 22*d* has a higher height to the side on which it has a lower height. As shown in FIG. 6, the reflective face 22*d* according to the present embodiment is designed such that the adjacent regions defined across the dotted line L3 as a boundary have opposite slope directions along the circumferential direction or the radial direction.

For example, the light input to the region R1 from the front side of the reflective face 22*d* of the rotating reflector 22R shown in FIG. 6 is reflected in an upper-left direction as viewed in a state shown in FIG. 6. In the same manner, the light input to the region R2 is reflected in a lower-left direction. The light input to the region R3 is reflected in an upper-right direction. The light input to the region R4 is reflected in a lower-right direction.

As described above, the reflective face 22*d* of the rotating reflector 22 is configured such that there is a difference in the reflection direction of the input light between the regions of the reflective face 22*d*. Accordingly, the reflection direction of the input light is changed in a periodic manner according to the rotation of the rotating reflector 22. By using this mechanism, such an arrangement allows the rotating reflector 22 to reflect and scan the light emitted from the first light source 20 while rotating, thereby forming a light distribution pattern.

Figure 7A:
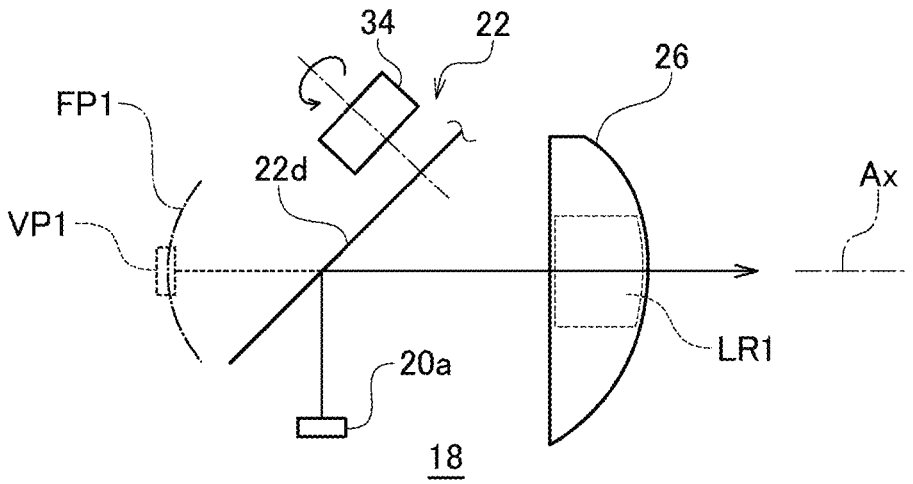
FIG. 7A is a schematic diagram for explaining the position relation between a light source, a virtual image of the light source, and the focal point of a lens when the rotating reflector of the optical unit according to the present embodiment is set to the first rotational position.
Figure 7B:
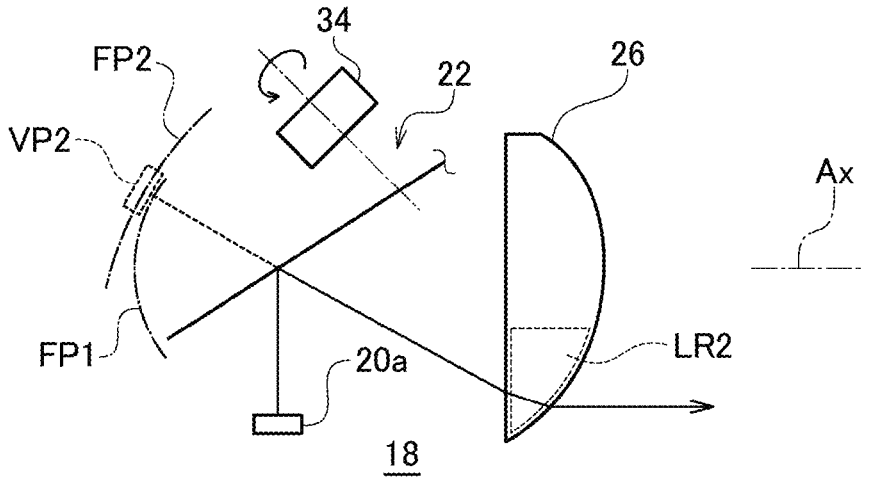
FIG. 7B is a schematic diagram for explaining the position relation between the light source, the virtual image of the light source, and the focal point of the lens when the rotating reflector of the optical unit according to the present embodiment is set to the second rotational position.
Figure 7C:
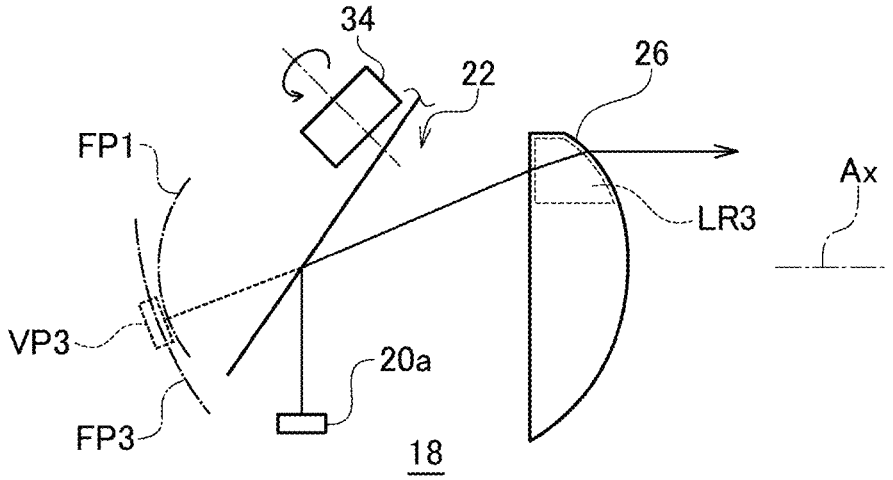
FIG. 7C is a schematic diagram for explaining the position relation between the light source, the virtual image of the light source, and the focal point of the lens when the rotating reflector of the optical unit according to the present embodiment is set to the third rotational position.
Figure 8A:
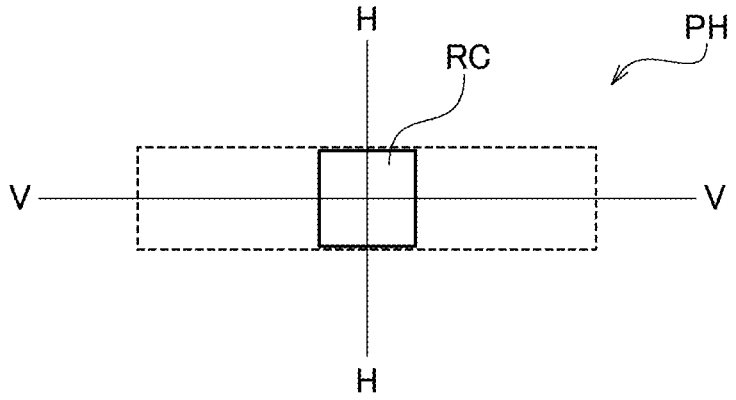
FIGS. 8A through 8C are schematic diagrams for explaining the light distribution patterns formed by the optical unit shown in FIGS. 7A through 7C.
Figure 8B:
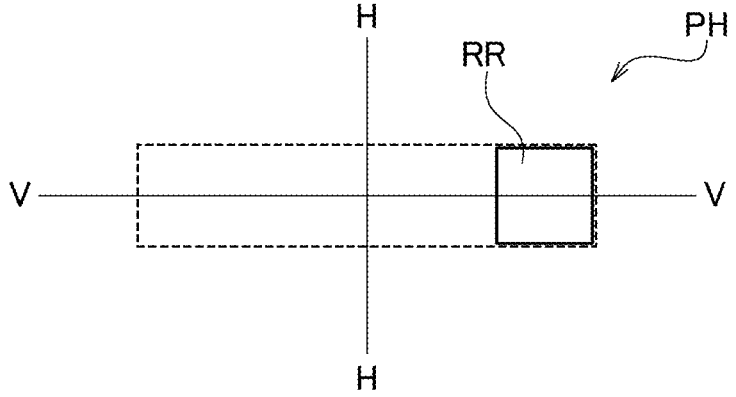
Figure 8C:
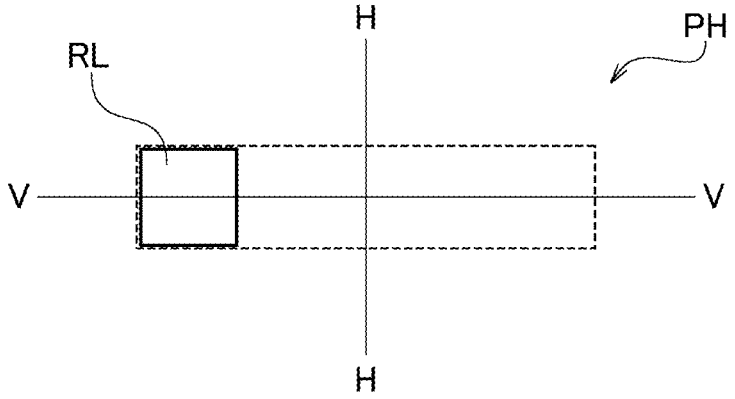

Next, description will be made regarding the formation of the light distribution pattern by means of the optical unit 18 according to the present embodiment. FIG. 7A is a schematic diagram for explaining the position relation between the light source, a virtual image of the light source, and a lens focal point when the rotating reflector of the optical unit according to the present embodiment is positioned at a first rotating position. FIG. 7B is a schematic diagram for explaining the position relation between the light source, a virtual image of the light source, and a lens focal point when the rotating reflector of the optical unit according to the present embodiment is positioned at a second rotating position. FIG. 7C is a schematic diagram for explaining the position relation between the light source, a virtual image of the light source, and a lens focal point when the rotating reflector of the optical unit according to the present embodiment is positioned at a third rotating position. FIGS. 8A through 8C are schematic diagrams for explaining the light distribution patterns formed by the optical unit shown in FIGS. 7A through 7C.

The convex lens 26 shown in FIG. 7A has a first lens region LR1 that defines the first focal plane FP1. Furthermore, the LED 20*a* configured as a light source is arranged such that, when the rotating reflector 22 is set to the first rotating position (at which the reflective face provides a reflection angle of 45° with respect to the optical axis Ax as shown in FIG. 7A, for example), the virtual image position VP1 is positioned in the vicinity of the first focal plane FP1 (preferably on the first focal plane FP1). Here, the optical axis can be regarded as, for example, a straight line parallel to the input light such that it passes through the focal point at which the light input in parallel from the front face of the lens is focused. Alternatively, the optical axis can be regarded as a straight line that extends in the front-rear direction of the vehicle within a horizontal plane such that it passes through the thickest portion of the convex lens. Alternatively, in a case of employing a circular (arc-shaped) lens, the optical axis can be regarded as a straight line that extends in the front-rear direction of the vehicle within a horizontal plane such that it passes through the center of the circle (arc).

The light output from the virtual image position VP1 in the vicinity of the first focal plane FP1 of the convex lens 26 passes through the first lens region LR1 of the convex lens 26, and is irradiated to a central region RC of a light distribution pattern PH as a clear light source image (see FIG. 8A). Accordingly, at least the central region RC of the light distribution pattern PH provides a clear pattern with improved concentration.

Next, when the rotating reflector 22 is set to the second rotating position (at which the reflective face provides a reflection angle of $(45-\alpha)°$ ($\alpha$ is 5 to 10°) with respect to the optical axis Ax as shown in FIG. 7B, for example), the virtual image position VP2 of the LED 20*a* is a position shifted from the first focal plane FP1. In this case, the light output from the virtual image position VP2 passes through the second lens region LR2 of the convex lens 26. However, the virtual image position VP2 is shifted from an extension of the first focal plane FP1. Accordingly, the light is irradiated to the right-end region RR of the light distribution pattern PH as an unclear light source image with weaker concentration.

As a cause of such a shift of the virtual image position VP2 from an extension of the focal plane FP1, it is conceivable that the reflective face of the rotating reflector 22 is not configured as a simple flat face. For example, the blade that functions as the reflective face of the rotating reflector according to the present embodiment has a twisted structure such that the angle defined between the optical axis and the reflective face changes along the circumferential direction with the rotational axis as the center. Accordingly, it is difficult to design the lens face of the convex lens 26 such that the virtual image position of the light source is positioned on a common focal plane regardless of the rotational position of the rotating reflector 22.

In order to solve such a problem, as shown in FIG. 7B, the convex lens 26 according to the present embodiment has a second lens region LR2 that defines a second focal plane FP2 that differs from the first focal plane FP1. With such an arrangement, the LED 20*a* is arranged such that the virtual image position VP2, which occurs when the rotating reflector 22 is positioned at the second rotational position, is in the vicinity of the second focal plane FP2.

The light output from the virtual image position VP2 in the vicinity of the second focal plane FP2 provided by the convex lens 26 passes through the second lens region LR2 of the convex lens 26, and is irradiated to the right-end region RR of the light distribution pattern PH as a clear light source image (see FIG. 8B). Accordingly, at least the right-side end region RR of the light distribution pattern PH provides a clear pattern with improved concentration.

As described above, such an arrangement allows the light emitted from the LED 20*a* to be focused easily regardless of whether the rotating reflector is positioned at the first rotational position or the second rotational position. Such an arrangement is capable of expanding the region where a clear light distribution pattern PH is formed by scanning the light projected in the light irradiation direction.

Next, when the rotating reflector 22 is set to the third rotating position (at which the reflective face provides a reflection angle of $(45+\alpha)°$ ($\alpha$ is 5 to 10°) with respect to the optical axis Ax as shown in FIG. 7C, for example), the virtual image position VP3 of the LED 20*a* is a position shifted from the first focal plane FP1. In this case, the light output from the virtual image position VP3 passes through the third lens region LR3 of the convex lens 26. However, the virtual image position VP3 is shifted from an extension of the first focal plane FP1. Accordingly, the light is irradiated to the left-end region RL of the light distribution pattern PH as an unclear light source image with weaker concentration.

In order to solve such a problem, as shown in FIG. 7C, the convex lens 26 according to the present embodiment has a third lens region LR3 that defines a third focal plane FP3 that differs from the first focal plane FP1. With such an arrangement, the LED 20*a* is arranged such that the virtual image position VP3, which occurs when the rotating reflector 22 is positioned at the third rotational position, is in the vicinity of the third focal plane FP3.

The light output from the virtual image position VP3 in the vicinity of the third focal plane FP3 provided by the convex lens 26 passes through the third lens region LR3 of the convex lens 26, and is irradiated to the left-end region RL of the light distribution pattern PH as a clear light source image (see FIG. 8C). Accordingly, at least the left-side end region RL of the light distribution pattern PH provides a clear pattern with improved concentration.

As described above, such an arrangement allows the light emitted from the LED 20*a* to be focused easily regardless of whether the rotating reflector is positioned at the first rotational position or the third rotational position. Such an arrangement is capable of expanding the region where a clear light distribution pattern PH is formed by scanning the light projected in the light irradiation direction.

Furthermore, the first lens region LR1 includes the center of the convex lens 26. The second lens region LR2 and the third lens region LR3 are each arranged on an outer side of the first lens region LR1. With this, a clear light distribution pattern PH can be provided over a region including the region where the light that has passed through the center of the projector lens is irradiated, and the outer-side regions thereof. That is to say, such an arrangement supports a clear light distribution pattern PH in both the central portion and the end portions thereof.

It should be noted that the lens face of the convex lens 26 may be designed for each of multiple divided regions thereof so as to provide the input face and the output face such that no intersection occurs within the convex lens 26 between the light beams reflected by the rotating reflector 22. This allows the lens face of the rotating reflector 22 to be designed in a simple manner.

Second Embodiment

Figure 9A:
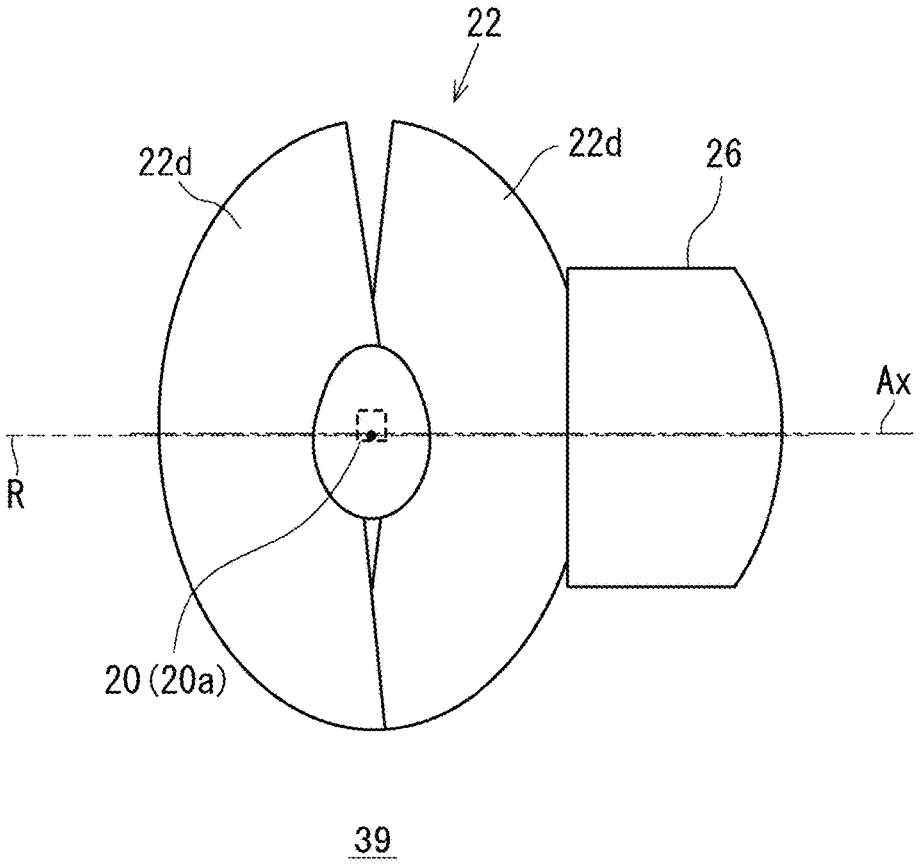
FIG. 9A is a side view showing a schematic configuration of the optical unit according to a reference example.
Figure 9B:
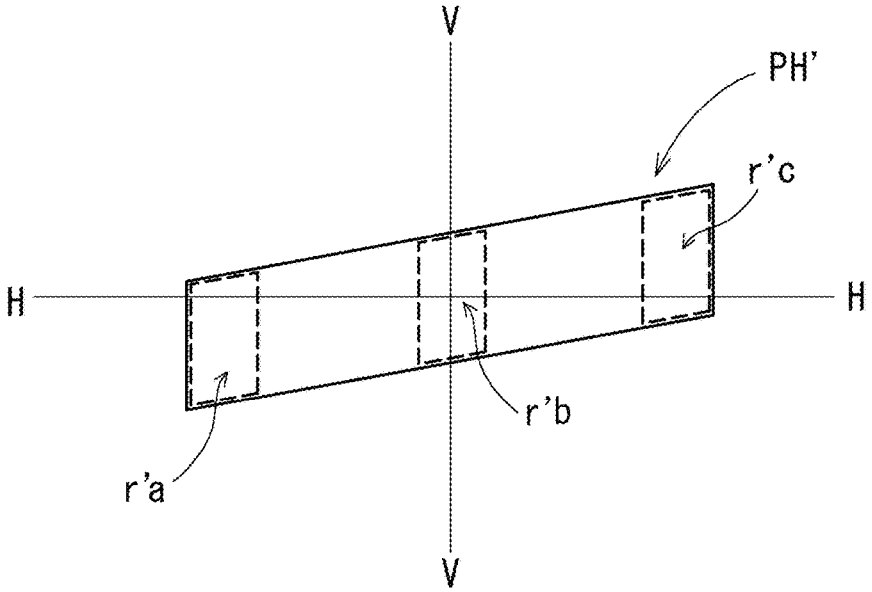
FIG. 9B is a schematic diagram for explaining the light distribution pattern formed by the optical unit according to the reference example.

Next, description will be made regarding the formation of a light distribution pattern by means of an optical unit including a rotating reflector according to the present embodiment. FIG. 9A is a side view showing a schematic configuration of the optical unit according to a reference example. FIG. 9B is a schematic diagram for explaining a light distribution pattern formed by the optical unit according to the reference example.

An optical unit 39 according to the reference example includes a first light source 20 including a light-emitting element such as an LED or the like, a rotating reflector 22 configured to be rotated in a single direction with its rotational axis as the center of rotation while reflecting the light emitted from the first light source 20, and a convex lens 26 configured to project the light reflected by the rotating reflector 22 in the light irradiation direction. The rotating reflector 22 is provided with a reflective face 22*d* around the rotational axis R such that it reflects the light output from the first light source 20 (light source image) while rotating, and such that the reflected light is projected by means of the convex lens 26, so as to form a light distribution pattern.

The optical unit 39 according to the reference example is arranged such that the optical axis Ax and the rotational axis R of the rotating reflector 22 are positioned on the same plane. Accordingly, as shown FIG. 9B, the light distribution pattern PH' formed by the optical unit 39 has a shape as obtained by scanning the light source image obliquely.

Figure 10A:
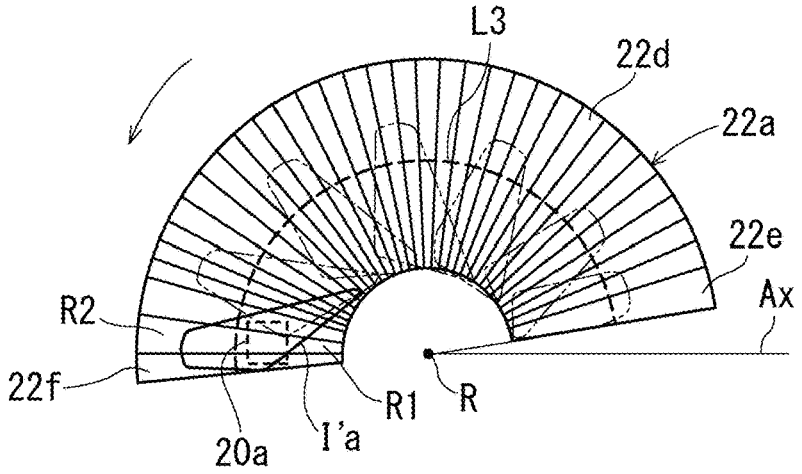
FIGS. 10A through 10C are diagrams for explaining the trajectory in a region where the light source image is irradiated to the reflective face of the rotating reflector according to the reference example.
Figure 10B:
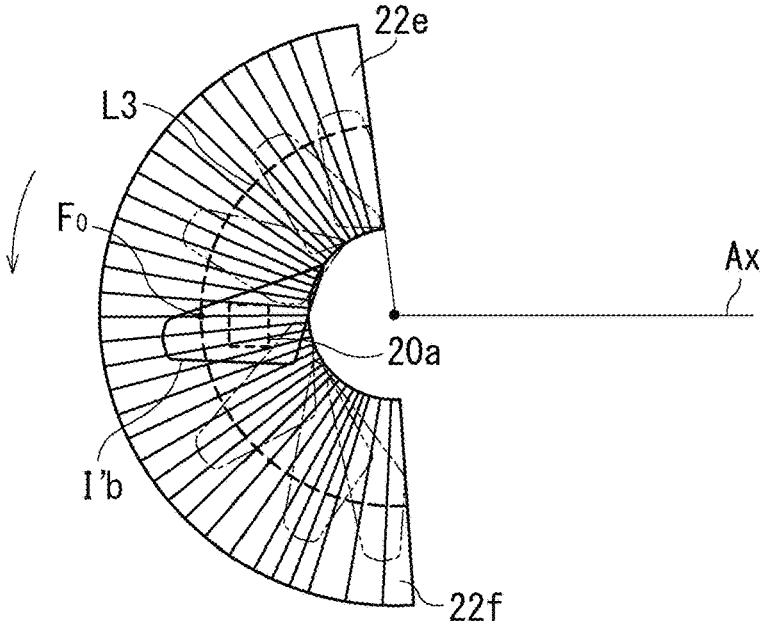
Figure 10C:
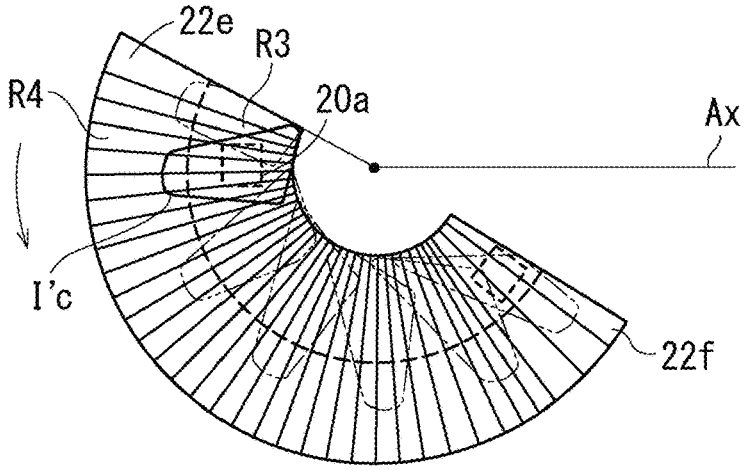

As a reason why the light distribution pattern PH' has a parallelogram shape having sides sloping with respect to the line H-H, the shape of the reflective face of the rotating reflector and the position relation between the reflective face and the light source are conceivable. FIGS. 10A through 10C are diagrams for explaining the trajectories of the light source image irradiated to a region of the reflective face of the rotating reflector according to the reference example. It should be noted that each diagram is shown directing attention to the reflective face 22*d* of one blade 22*a*.

As shown in FIG. 6 or the like, each reflective face 22*d* of the rotating reflector 22 has a twisted structure instead of a flat structure. Accordingly, the light source image projected onto the reflective face 22*d* according to the rotation of the blade 22*a* changes greatly due to the reflecting position or the reflecting angle provided by the blade even if the LED 20*a* of the first light source 20 has a rectangular shape.

For example, in a state in which the blade 22*a* is set to the rotational position shown in FIG. 10A, a portion of the outer circumference portion of the blade 22*a* in the vicinity of the end portion 22*f* having a larger height in the axial direction is positioned such that it faces the light-emitting face of the LED 20*a*. Furthermore, the light-emitting face of the LED 20*a* has a slope with respect to the reflective face 22*d* of the blade 22*a*. Accordingly, as shown in FIG. 10A, the light source image I'a projected onto the reflective face 22*d* has a simple quadrangular shape that is neither a parallelogram nor a trapezoid. Furthermore, in the end portion 22*f* of the reflective face 22*d*, the outer-side region thereof with respect to the dotted line L3 is configured such that it reflects light upward. Accordingly, in the light source image I'a projected on the reflective face 22*d*, a portion thereof reflected by the region R2 (see FIG. 6) (outer-side region thereof with respect to the dotted line L3) is reflected to the upper side. Conversely, a portion of the light source image I'a reflected by the region R1 (see FIG. 6) (an inner-side region thereof with respect to the dotted line L3) is reflected to the lower side. With this, after the reflected light passes through the convex lens 26, the reflected light is irradiated to the left-end region r'a of the light distribution pattern PH', i.e., is mainly irradiated to a lower-side region with respect to the line H-H.

Subsequently, the blade 22*a* is rotated in a counterclockwise direction from the state shown in FIG. 10A, and is set to a state at the rotational position shown in FIG. 10B. In this state, a particular region of the reflective face 22*d* including the point $F_0$ at which the normal vector thereof is parallel to the rotational axis of the rotating reflector 22R faces the light-emitting face of the LED 20*a*. Furthermore, the light-emitting face of the LED 20*a* has a slope with respect to the reflective face 22*d* of the blade 22*a*. Accordingly, as shown in FIG. 10B, the light source image I'b projected onto the reflective face 22*d* has a simple quadrangular shape. Furthermore, the region including the point $F_0$ is configured such that it reflects toward the front side and toward neither the upper side nor the lower side. Accordingly, the light source image I'b is mainly reflected in a front-side direction (in a direction that is parallel to the rotational axis R). After the reflected light passes through the convex lens 26, the light is irradiated to a central region r'b of the light distribution pattern PH'. Furthermore, the ratio of the light source image I'b that is reflected by the region R2 is lower than that of the light source image I'a. Accordingly, the central region r'b of the light distribution pattern PH' has a lower-side region with respect to the line H-H that is smaller than that of the left-end region r'a.

Subsequently, the blade 22*a* is rotated in a counterclockwise direction from the state shown in FIG. 10B, and is set to a state at the rotational position thereof shown in FIG. 10C. In this state, a portion of the outer circumference portion of the blade 22*a* in the vicinity of the end portion 22*e* having a smaller height in the axial direction is positioned such that it faces the light-emitting face of the LED 20*a*. Furthermore, the light-emitting face of the LED 20*a* has a slope with respect to the reflective face 22*d* of the blade 22*a*. Accordingly, as shown in FIG. 10C, the light source image I'c projected onto the reflective face 22*d* has a simple quadrangular shape that is neither a parallelogram nor a trapezoid. However, in this state, the light is reflected at a smaller angle. Accordingly, the light source image I'c has a shape that is closer to that of the light-emitting face itself as compared with the light source image I'a. Furthermore, the end portion 22*e* of the reflective face 22*d* is configured such that an outer-side region thereof with respect to the dotted line L3 reflects light upward. Accordingly, in the light source image I'c, a portion thereof reflected by the region R4 (see FIG. 6) (outer-side region thereof with respect to the dotted line L3) is reflected to the upper side. Conversely, a portion of the light source image I'c reflected by the region R3 (see FIG. 6) (an inner-side region thereof with respect to the dotted line L3) is reflected to the lower side. With this, after the reflected light passes through the convex lens 26, the reflected light is irradiated to the right-end region r'c of the light distribution pattern PH'. Furthermore, the ratio of the light source image I'c that is reflected by the region R4 is lower than that of the light source images I'a and I'b. Accordingly, the right-end region r'c of the light distribution pattern PH' has a lower-side region with respect to the line H-H that is smaller than that of the left-end region r'a and the central region r'b.

As described above, the position of the light source image on the reflective face 22*d* (in particular, the position on the reflective face 22*d* in the radial direction) is shifted according to the rotational position of the blade 22*a*. It is conceivable that this is why the light distribution pattern PH' is generated with a slope.

Figure 11A:
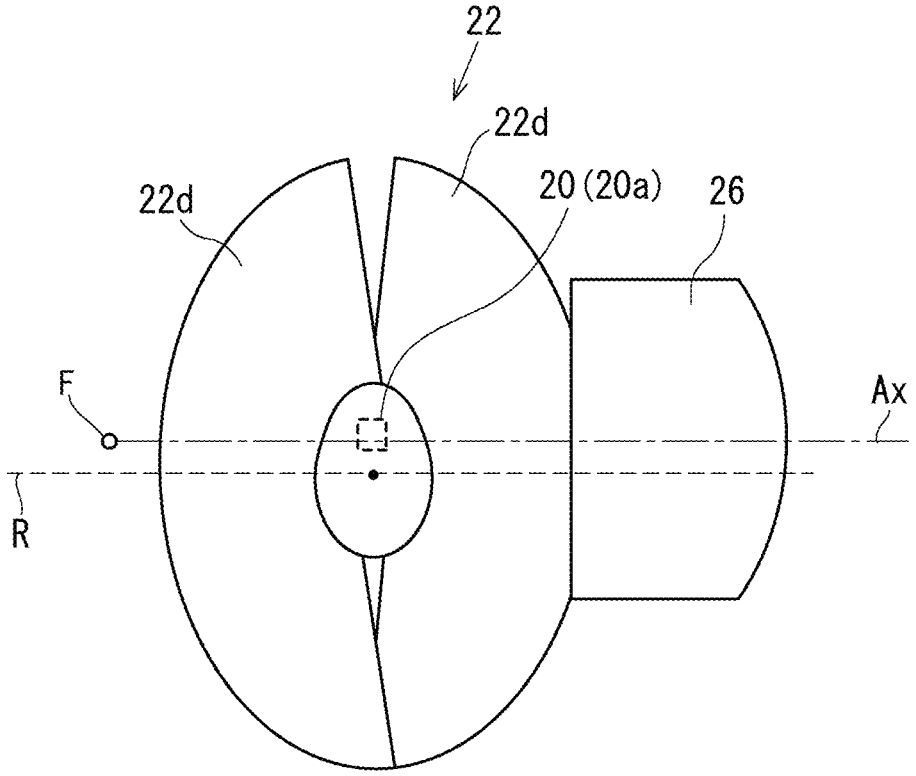
FIG. 11A is a side view showing a schematic configuration of the optical unit according to the present embodiment.
Figure 11B:
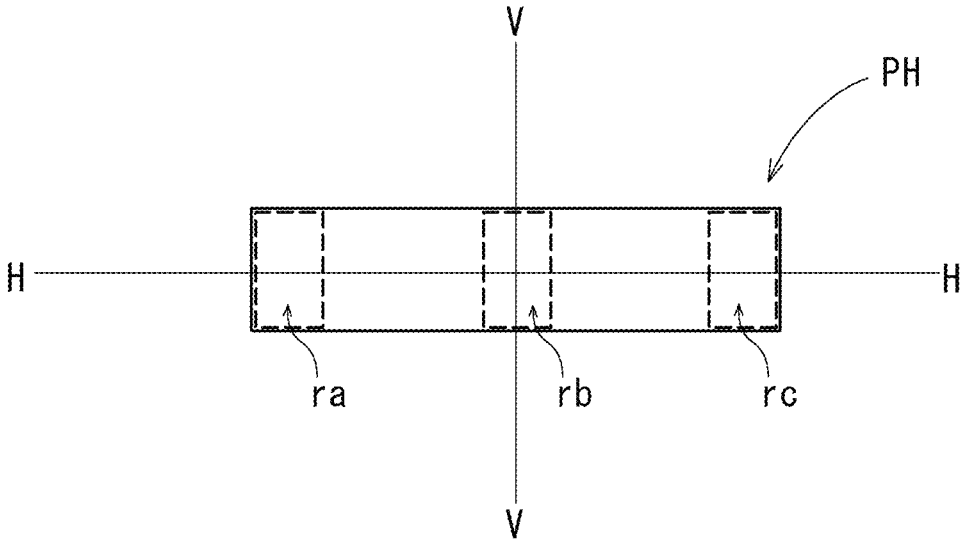
FIG. 11B is a schematic diagram for explaining the light distribution pattern formed by the optical unit according to the present embodiment.
Figure 12A:
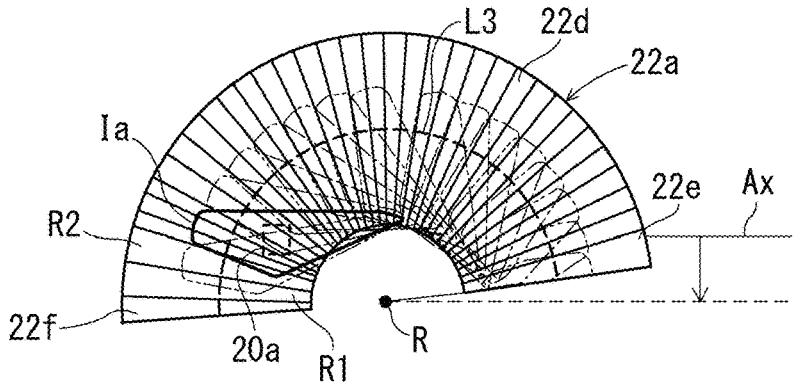
FIGS. 12A through 12C are diagrams for explaining the trajectory in a region where the light source image is irradiated to the reflective face of the rotating reflector according to the present embodiment.
Figure 12B:
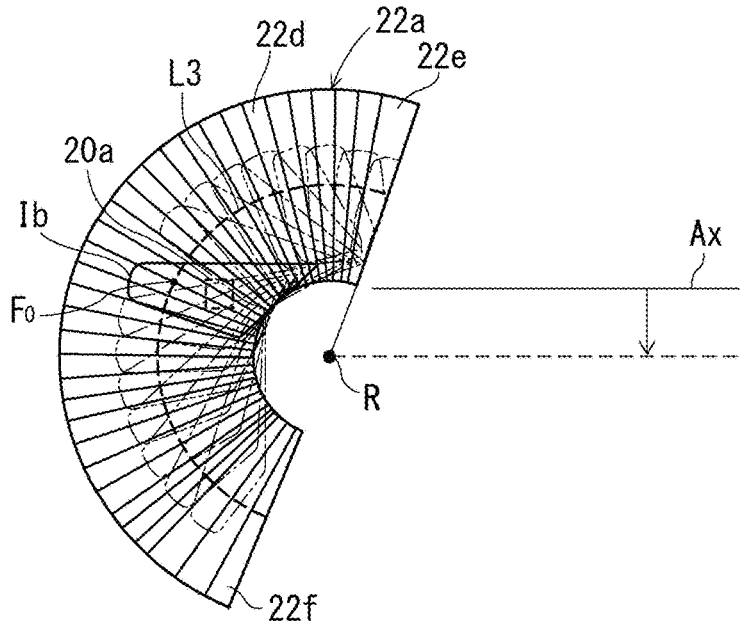
Figure 12C:
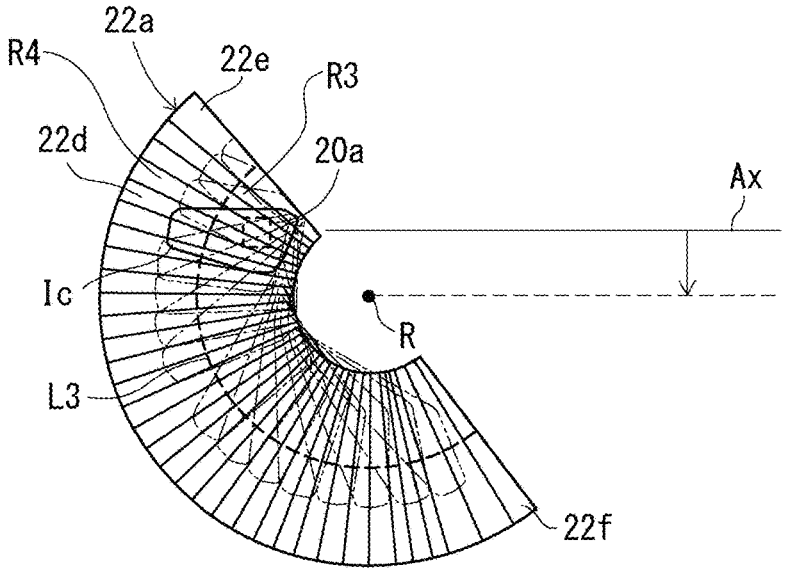

In order to solve such a problem, the present inventors have conducted diligent studies, and have devised a configuration described below. FIG. 11A is a side view showing a schematic configuration of an optical unit according to the present embodiment. FIG. 11B is a schematic diagram for explaining the light distribution pattern formed by the optical unit according to the present embodiment. FIGS. 12A through 12C are diagrams for explaining the trajectories of the light source image irradiated to a region of the reflective face of the rotating reflector according to the present embodiment.

An optical unit 18 according to the present embodiment has almost the same configuration as that of the optical unit 39 described above. There is a difference in the position of the rotating reflector 22 between the optical unit 18 according to the present embodiment and the optical unit 39 described above. Specifically, as shown in FIG. 11A, the rotating reflector 22 is provided with the reflective face 22*d* around the rotational axis R configured such that, when the light output from the first light source 20 is reflected by the rotating reflector 22 while it rotates, and is projected by means of the convex lens 26, the light distribution pattern as shown in FIG. 11B is formed. The rotational axis R is arranged with a slope with respect to the front-rear direction of the optical unit 18 (see FIG. 3). Furthermore, the rotational axis R is arranged with a shift with respect to a plane including the focal point F of the convex lens 26 such that the scanning direction in which the light distribution pattern PH is generated becomes closer to the horizontal direction.

As described above, as a reason why the light distribution pattern PH formed by the optical unit according to the present embodiment has a rectangular shape that is parallel to the line H-H, it is conceivable that it is because the rotational axis R is arranged with a shift downward with respect to the plane including the focal point F of the convex lens 26. Detailed description will be made below regarding this reason.

For example, in a state in which the blade 22*a* is set to the rotational position shown in FIG. 12A, a portion of the outer circumference portion of the blade 22*a* in the vicinity of the end portion 22*f* having a larger height in the axial direction is positioned such that it faces the light-emitting face of the LED 20*a*. Furthermore, the light-emitting face of the LED 20*a* has a slope with respect to the reflective face 22*d* of the blade 22*a*. Accordingly, as shown in FIG. 12A, the light source image Ia projected onto the reflective face 22*d* has a simple quadrangular shape that is neither a parallelogram nor a trapezoid. Furthermore, in the end portion 22*f* of the reflective face 22*d*, the outer-side region thereof with respect to the dotted line L3 is configured such that it reflects light upward. Accordingly, in the light source image Ia, a portion thereof reflected by the region R2 is reflected to the upper side. Conversely, a portion of the light source image Ia reflected by the region R1 is reflected to the lower side. With this, after the reflected light passes through the convex lens 26, the reflected light is irradiated to the left-end region ra of the light distribution pattern PH.

Subsequently, the blade 22*a* is rotated in a counterclockwise direction from the state shown in FIG. 12A, and is set to a state at the rotational position thereof shown in FIG. 12B. In this state, a particular region of the reflective face 22*d* including the point $F_0$ at which the normal vector thereof is parallel to the rotational axis of the rotating reflector 22R faces the light-emitting face of the LED 20*a*. Furthermore, the light-emitting face of the LED 20*a* has a slope with respect to the reflective face 22*d* of the blade 22*a*. In this case, as shown in FIG. 12B, the light source image Ib projected onto the reflective face 22*d* has a simple quadrangular shape. Furthermore, the region including the point $F_0$ is configured such that it reflects toward the front side and toward neither the upper side nor the lower side. Accordingly, the light source image Ib is mainly reflected in a front-side direction (in a direction that is parallel to the rotational axis R) of the rotating reflector 22. After the reflected light passes through the convex lens 26, the light is irradiated to a central region rb of the light distribution pattern PH. Furthermore, in the light source image Ib, almost the same region thereof is reflected by the region R2 as compared with the light source image Ia. Accordingly, the central region rb of the light distribution pattern PH has a similarly shaped region including the line H-H defined in the upper-lower direction as compared with the left-end region ra.

Subsequently, the blade 22*a* is rotated in a counterclockwise direction from the state shown in FIG. 12B, and is set to a state at the rotational position thereof shown in FIG. 12C. In this state, a portion of the outer circumference portion of the blade 22*a* in the vicinity of the end portion 22*e* having a smaller height in the axial direction is positioned such that it faces the light-emitting face of the LED 20*a*. Furthermore, the light-emitting face of the LED 20*a* has a slope with respect to the reflective face 22*d* of the blade 22*a*. Accordingly, as shown in FIG. 12C, the light source image Ic projected onto the reflective face 22*d* has a simple quadrangular shape that is neither a parallelogram nor a trapezoid. However, in this state, the light is reflected at a smaller angle. Accordingly, the light source image Ic has a shape that is closer to that of the light-emitting face itself as compared with the light source image Ia. Furthermore, the end portion 22*e* of the reflective face 22*d* is configured such that an outer-side region thereof with respect to the dotted line L3 reflects light upward. Accordingly, in the light source image Ic, a portion thereof reflected by the region R4 is reflected to the upper side. Conversely, a portion of the light source image Ic reflected by the region R3 is reflected to the lower side. With this, after the reflected light passes through the convex lens 26, the reflected light is irradiated to the right-end region rc of the light distribution pattern PH. Furthermore, in the light source image Ic, almost the same region thereof is reflected by the region R4 as compared with the light source image Ia and the light source image Ib. Accordingly, the right-end region rc of the light distribution pattern PH has a similarly shaped region including the line H-H defined in the upper-lower direction as compared with the left-end regions ra and rb.

As described above, the optical unit 18 according to the present embodiment is capable of forming the light distribution pattern PH defined in the scanning direction that is close to the horizontal direction. Furthermore, with the rotating reflector 22 according to the present embodiment, the rotational axis R thereof is arranged with a shift in the upper-lower direction with respect to the plane including the focal point F of the convex lens 26. With this, the light distribution pattern PH can be designed such that it becomes closer to its desired shape by changing the layout of a part of the components that form the optical unit.

It should be noted that, as shown in FIG. 1, the first light source 20 according to the present embodiment is arranged between the front end and the rear end of a region in which the rotating reflector 22 is mounted, in the front-rear direction of the optical unit 18. Furthermore, the first light source 20 is arranged between both ends of a region where the convex lens 26 and the rotating reflector 22 are mounted, in a direction that is orthogonal to the front-rear direction of the optical unit. Moreover, the first light source 20 is arranged within a region where the rotating reflector is mounted, in a direction that is orthogonal to the front-rear direction of the optical unit 18. In other words, the first light source 20 is arranged such that it overlaps the reflective face 22*d* of the rotating reflector 22 as viewed from the side of the optical unit 18.

Third Embodiment (Method for Determining Reflective Face of Rotating Reflector)

Figure 13:
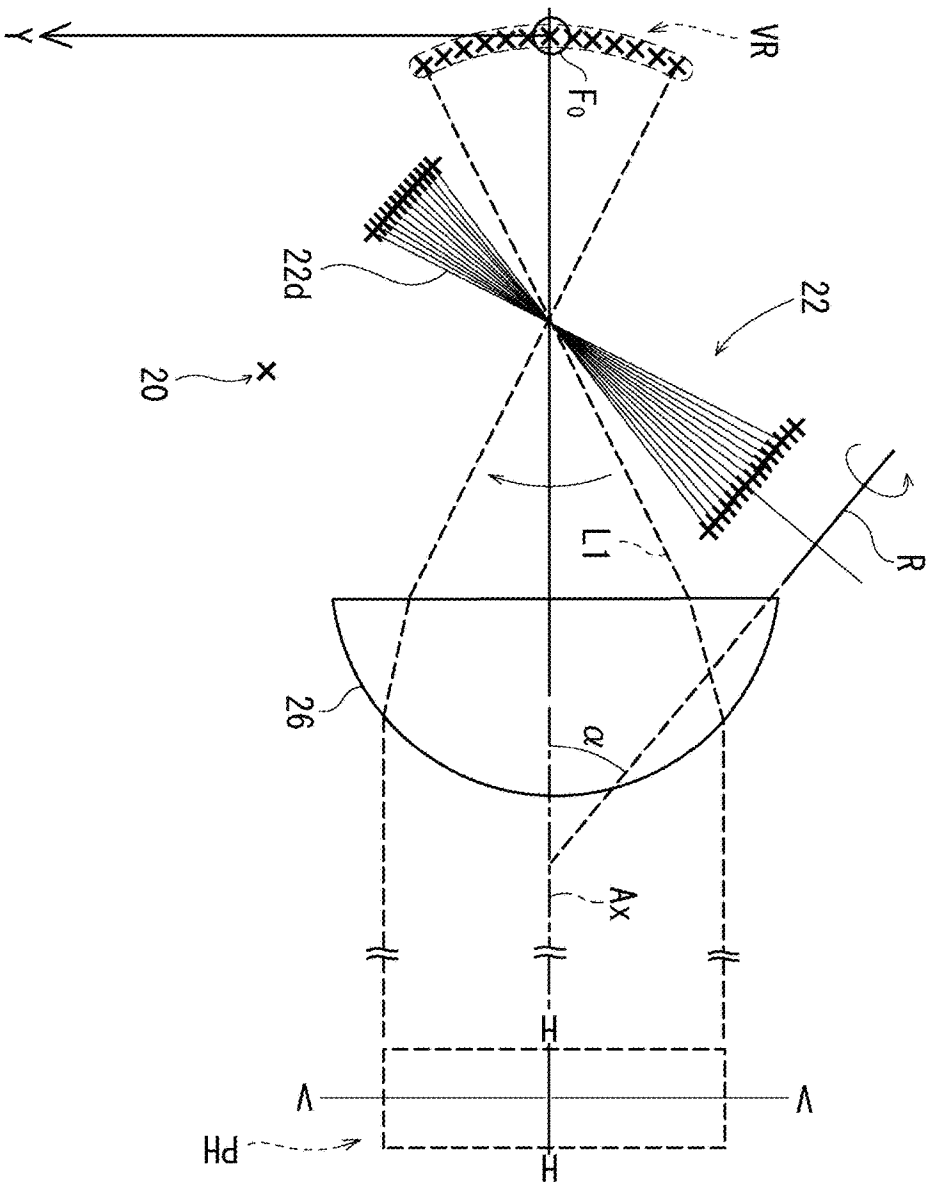
FIG. 13 is a schematic diagram for explaining a method for determining the reflective face to be formed in the optical unit according to the present embodiment.
Figure 14:
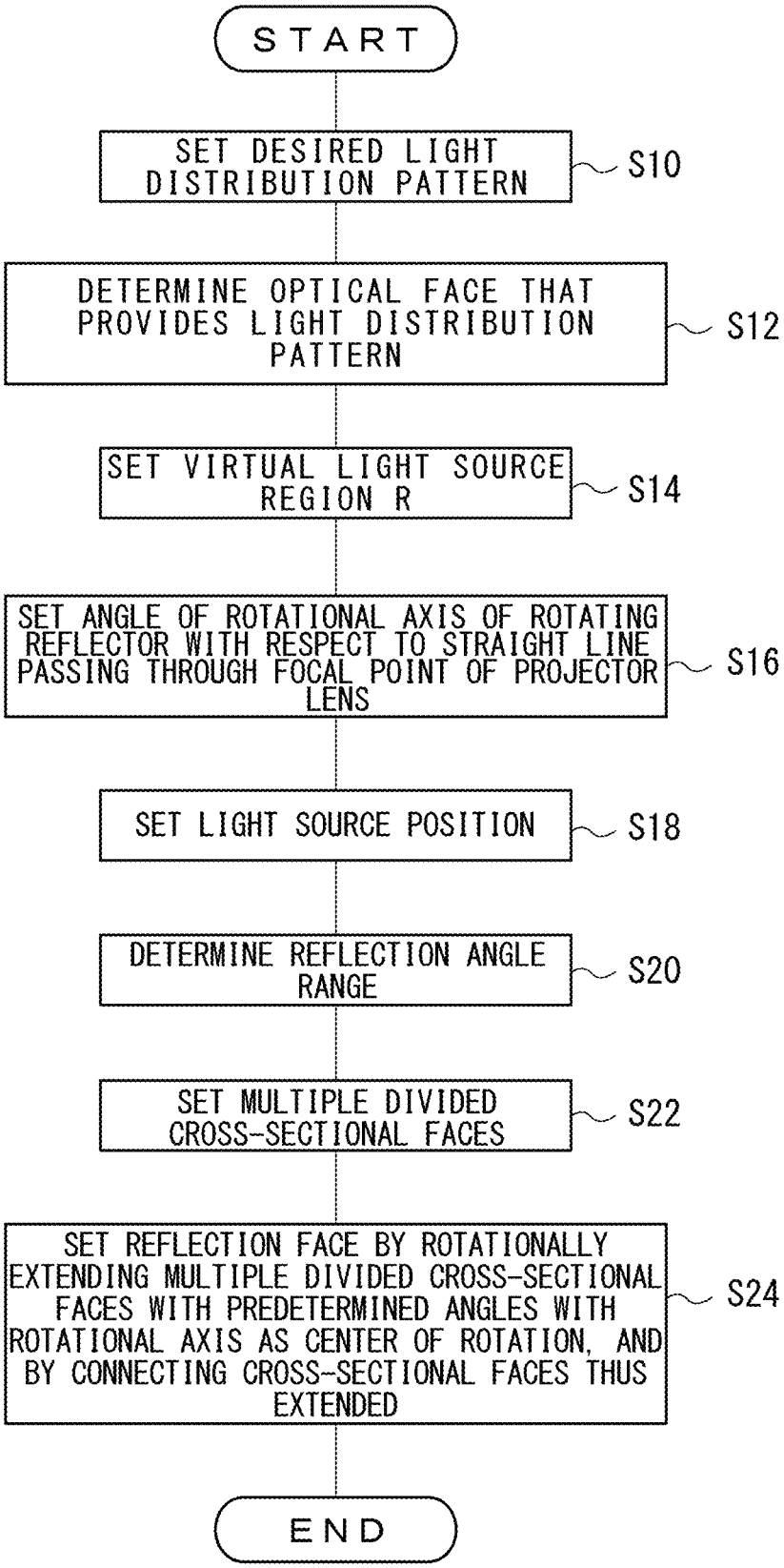
FIG. 14 is a flowchart showing a reflective face determining method according to the present embodiment.

FIG. 13 is a schematic diagram for explaining a method for determining the reflective face supported by the optical unit according to the present embodiment. FIG. 14 is a diagram showing a flowchart for the reflective face determining method according to the present embodiment. The reflective face determining method according to the present embodiment is a method for determining the reflective face 22*d* of the rotating reflector 22 configured to be rotated in a single direction with the rotational axis R as the center of rotation while reflecting the light emitted from the first light source 20.

First, a desired light distribution pattern PH to be formed on the front side is set (S10 in FIG. 14). Furthermore, an optical face such as an input face and an output face of the projector lens (convex lens 26) are set so as to provide the light distribution pattern PH (Step S12 in FIG. 14). Next, a region VR of a virtual light source regarded as emitting the first light L1 projected as the light distribution pattern PH is set (Step S14 in FIG. 14). Furthermore, the angle $\alpha$ of the rotational axis R of the rotating reflector 22 with respect to a straight line that passes through the focal point $F_0$ of the convex lens 26 (e.g., the optical axis Ax shown in FIG. 13) is set. The angle $\alpha$ is set to 45°, for example.

Next, the position of the first light source 20 is set (Step S18 in FIG. 14). Furthermore, the range of the reflection angle of the rotating reflector 22 is set such that the virtual image position of the first light source 20 matches the virtual light source region VR (S20 in FIG. 14). FIGS. 15A through 15F are schematic diagrams for further explaining the step S20.

Figure 15A:
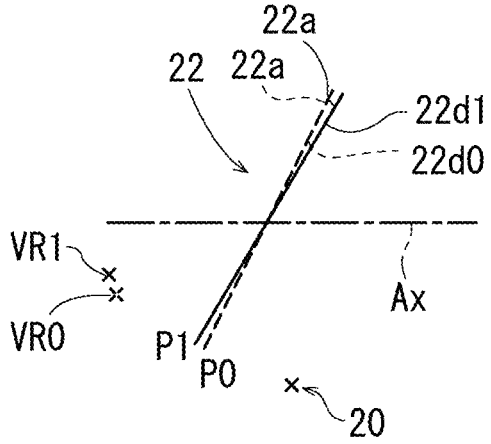
FIGS. 15A through 15F are schematic diagrams for further explaining Step S20.
Figure 15D:
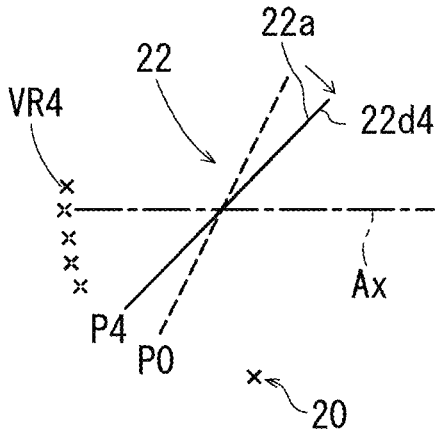

As shown in FIG. 15A, when the blade 22*a* is set to the rotational position P0, the reflective face 22*d*0 of the blade 22*a* is set such that the end portion region VR0 of the virtual light source region VR matches the virtual image position of the first light source 20. That is to say, there is a symmetrical position relation across the reflective face 22*d*0 between the first light source 20 and the region VR0.

Figure 15B:
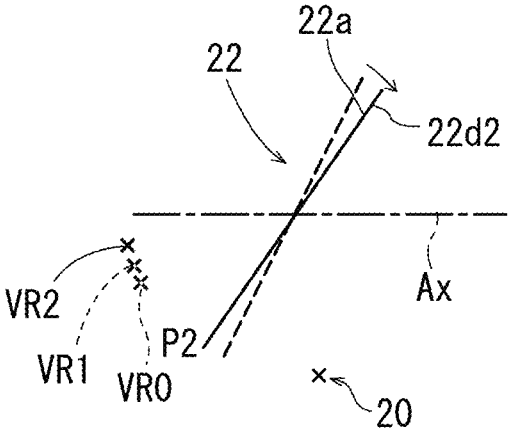
Figure 15E:
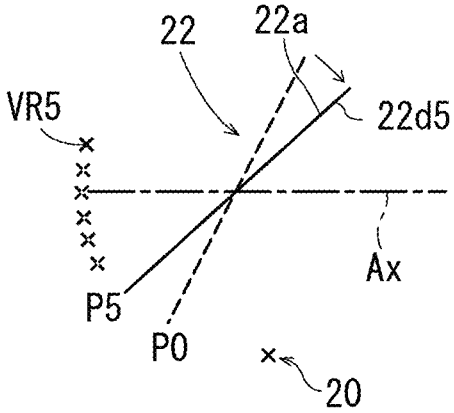

Next, when the blade 22*a* is rotated and is positioned at the rotational position P1 as shown in FIG. 15B, the reflective face 22*d*1 of the blade 22*a* is set such that the region VR1 of the virtual light source matches the virtual image position of the first light source 20. That is to say, there is a symmetrical position relation across the reflective face 22*d*1 between the first light source 20 and the region VR1.

Figure 15C:
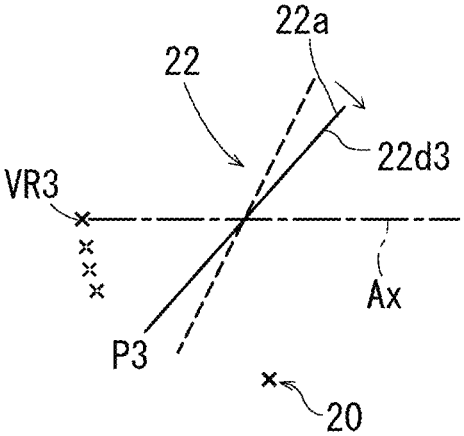
Figure 15F:
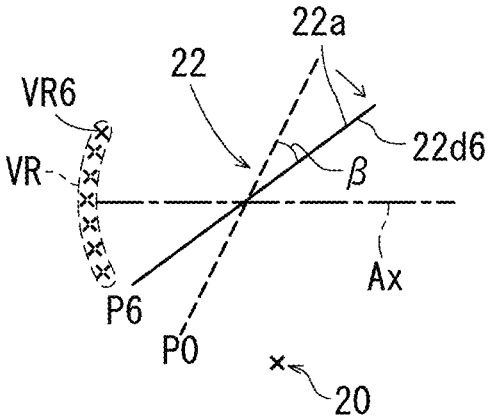

Next, when the blade 22*a* is rotated and is positioned at the rotational position P2 as shown in FIG. 15C, the reflective face 22*d*2 of the blade 22*a* is set such that the region VR2 of the virtual light source matches the virtual image position of the first light source 20. That is to say, there is a symmetrical position relation across the reflective face 22*d*2 between the first light source 20 and the region VR2.

In the same way, when the blade 22*a* is sequentially rotated and is sequentially positioned at the rotational positions P3 through P6 as shown in FIGS. 15C through 15F, the reflective faces 22*d*3 through 22*d*6 of the blade 22*a* are set such that the regions VR3 through VR6 of the virtual light source match the virtual image positions of the first light source 20. That is to say, there is a symmetrical position relation between the first light source 20 and each of the regions VR3 through VR6 across the corresponding reflective face from among the reflective faces 22*d*3 through 22*d*6.

In the present embodiment, the rotational positions P0 through P6 are provided by rotating the blade 22*a* in a rotational angle range of 180° with the rotational axis R as the center of rotation. Furthermore, the reflection angle range β (FIG. 15F) supported by the reflective faces 22*d*0 through 22*d*6 of the blade 22*a* provided at the rotational positions of P0 to P6 is set to a range of ±5° to ±10° with respect to a plane that is orthogonal to the rotational axis R. This arrangement is capable of forming the light distribution pattern PH irradiated to a desired region in front of the vehicle.

Figure 16:
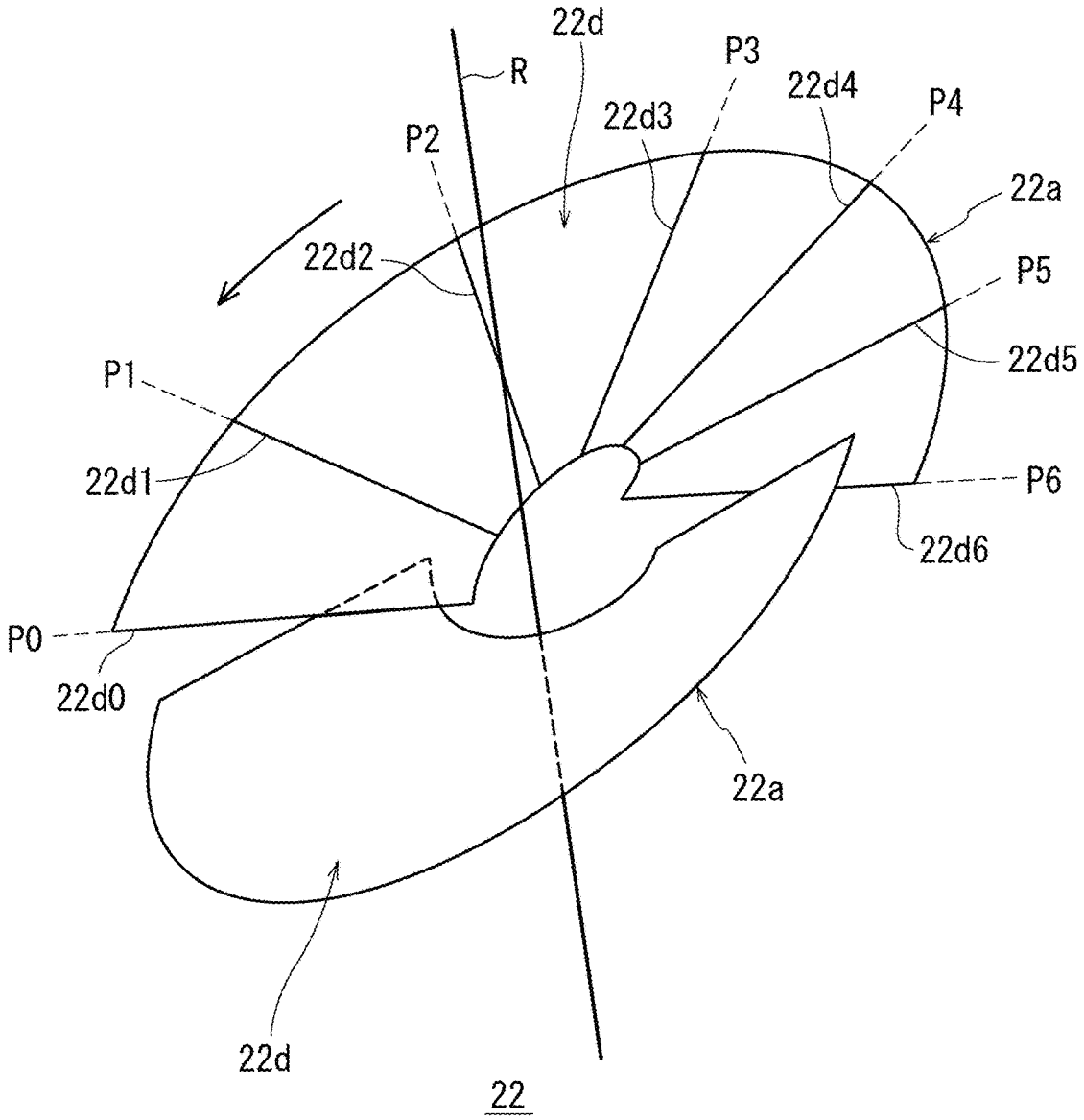
FIG. 16 is a schematic diagram for explaining a step for setting the reflective face of the rotating reflector.

FIG. 16 is a schematic diagram for explaining a step for setting the reflective face of the rotating reflector. Multiple divided cross-sectional face portions are set so as to support the reflection angle range β described above (S22 in FIG. 14). In the present embodiment, the seven reflective faces 22*d*0 through 22*d*6 are set as the divided cross-sectional face portions. With this, the reflective faces 22*d*0 through 22*d*5 are rotationally extended at a predetermined rotational angle toward the adjacent reflective faces 22*d*1 through 22*d*6 with the rotational axis R as the center of rotation. Furthermore, the reflective faces thus extended are connected so as to set the reflective face 22*d* of the rotating reflector 22 (S24 in FIG. 14).

It should be noted that each reflective face and each connection that connects adjacent reflective faces may be gently adjusted. With such a method, the shape of the reflective face 22*d* of the rotating reflector 22 can be determined so as to form a desired light distribution pattern PH in the front side. In other words, such a method allows the shape of the reflective face 22*d* of the rotating reflector 22 to be determined by setting a desired light distribution pattern PH.

Description has been made in the present embodiment regarding an example in which the reflective faces 22*d*0 through 22*d*6 configured as multiple divided cross-sectional face portions are set such that the reflection angles are shifted at equal pitches (β/6). This allows the reflective face 22*d* to be designed easily. Furthermore, in the rotating reflector 22 according to the present embodiment, the reflective face is set such that, after the rotating reflector 22 reflects the light output from the first light source 20 while rotating, the reflected light forms a desired light distribution pattern.

Fourth Embodiment (Rotating Reflector)

Figure 17:
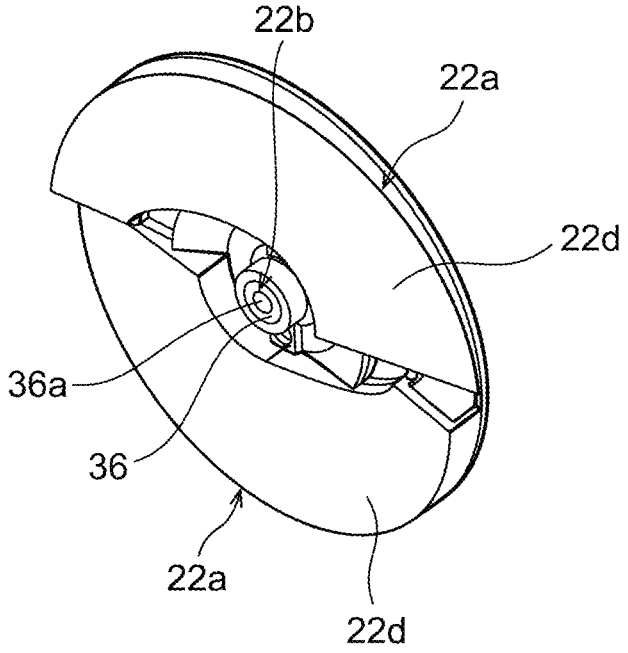
FIG. 17 is a perspective view of the rotating reflector according to the present embodiment.
Figure 18:
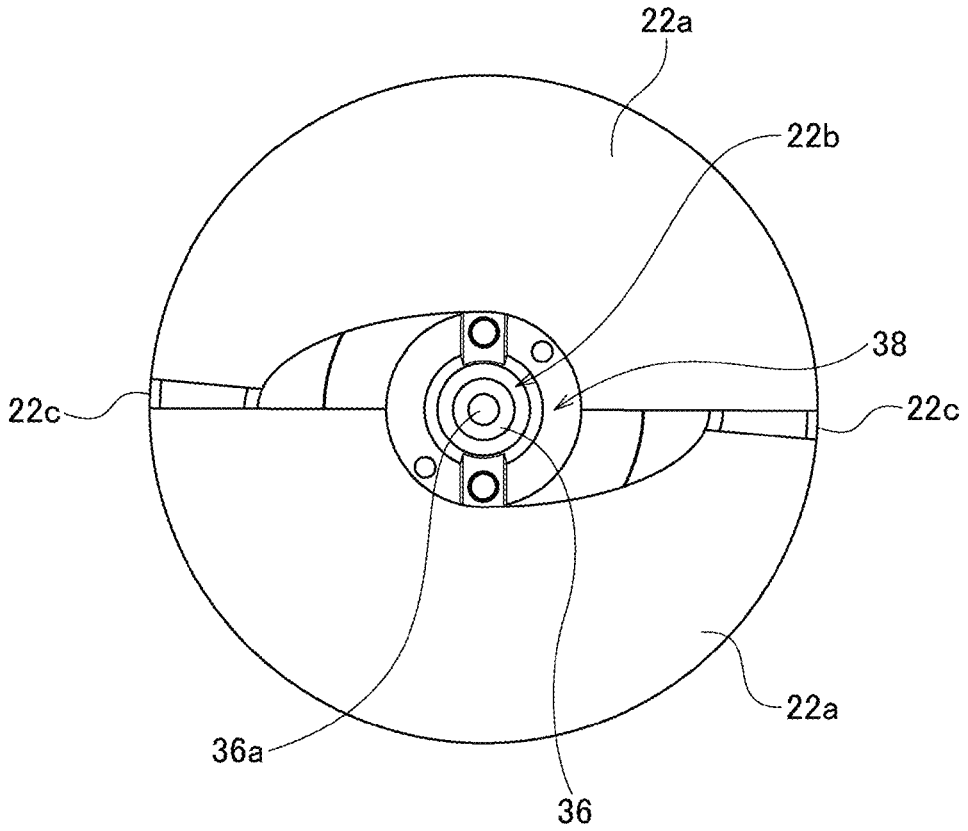
FIG. 18 is a front view of the rotating reflector according to the present embodiment.

Next, description will be made regarding a structure of the rotating reflector 22 according to the present embodiment. FIG. 17 is a perspective view of the rotating reflector according to the present embodiment. FIG. 18 is a front view of the rotating reflector according to the present embodiment.

The rotating reflector 22 is configured as a component formed of a resin material including the rotating portion 22*b*, and the multiple (two) blades 22*a* arranged around the rotating portion 22*b*, and each functioning as a reflective face configured to form a light distribution pattern by reflecting the light emitted from the first light source 20 while rotating. Each blade 22*a* is configured as an arc-shaped component. The blades 22*a* are coupled adjacent to each other via their outer circumferential portions by means of a coupling portion 22*c*, so as to form a ring-shaped structure. This allows the rotating reflector 22 to be less readily subject to distortion even if the rotating reflector 22 rotates at a high speed (with a rotational speed of 50 to 240 r/s, for example).

A cylindrical sleeve 36 having an opening 36*a* through which the rotational shaft of the rotating reflector 22 is inserted and fitted is fixedly mounted at the center of the rotating portion 22*b* by insert molding. Furthermore, a ring-shaped groove 38 is formed along the outer circumferential portion of the rotating portion 22*b* such that it corresponds to the inner side of each blade 22*a*.

(Shade)

Figure 19A:
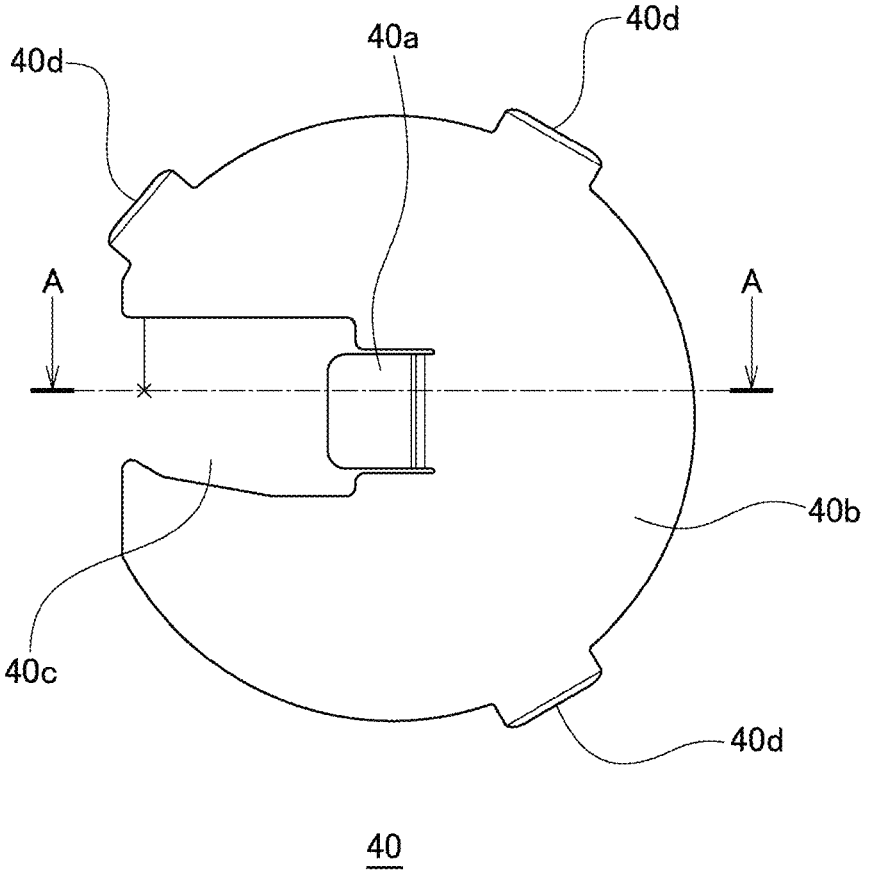
FIG. 19A is a front view of a shade according to the present embodiment.
Figure 19B:
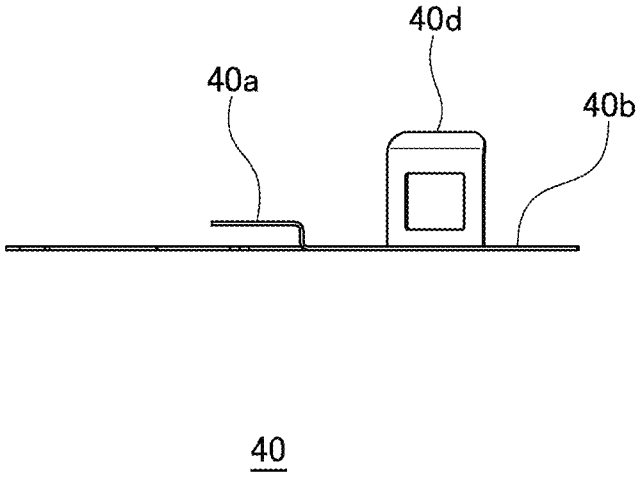
FIG. 19B is a cross-sectional diagram showing the shade taken along line A-A shown in FIG. 19A.

FIG. 19A is a front view of a shade according to the present embodiment. FIG. 19B is a cross-sectional view of the shade taken along the line A-A shown in FIG. 19A. A shade 40 according to the present embodiment is configured as a disk-shaped member formed of a metal material, which is subjected to matte coating in order to suppress reflection that occurs on the surface thereof. The shade 40 includes a central shielding portion 40*a* to be arranged above the rotating portion 22*b* of the rotating reflector 22, and a reflective face shielding portion 40*b* arranged around the central shielding portion 40*a* so as to block light that passes toward the reflective face (blade 22*a*) of the rotating reflector 22.

An aperture portion 40*c* is formed in a portion of the reflective face shielding portion 40*b* such that the light emitted from the first light source 20 passes toward the blade 22*a*, and such that the light reflected by the blade 22*a* passes through. Furthermore, three snap-fit portions 40*d* are provided to the outer circumferential portion so as to allow the shade 40 to be fixedly mounted on an unshown cylindrical casing configured to house the rotating reflector 22.

Figure 20:
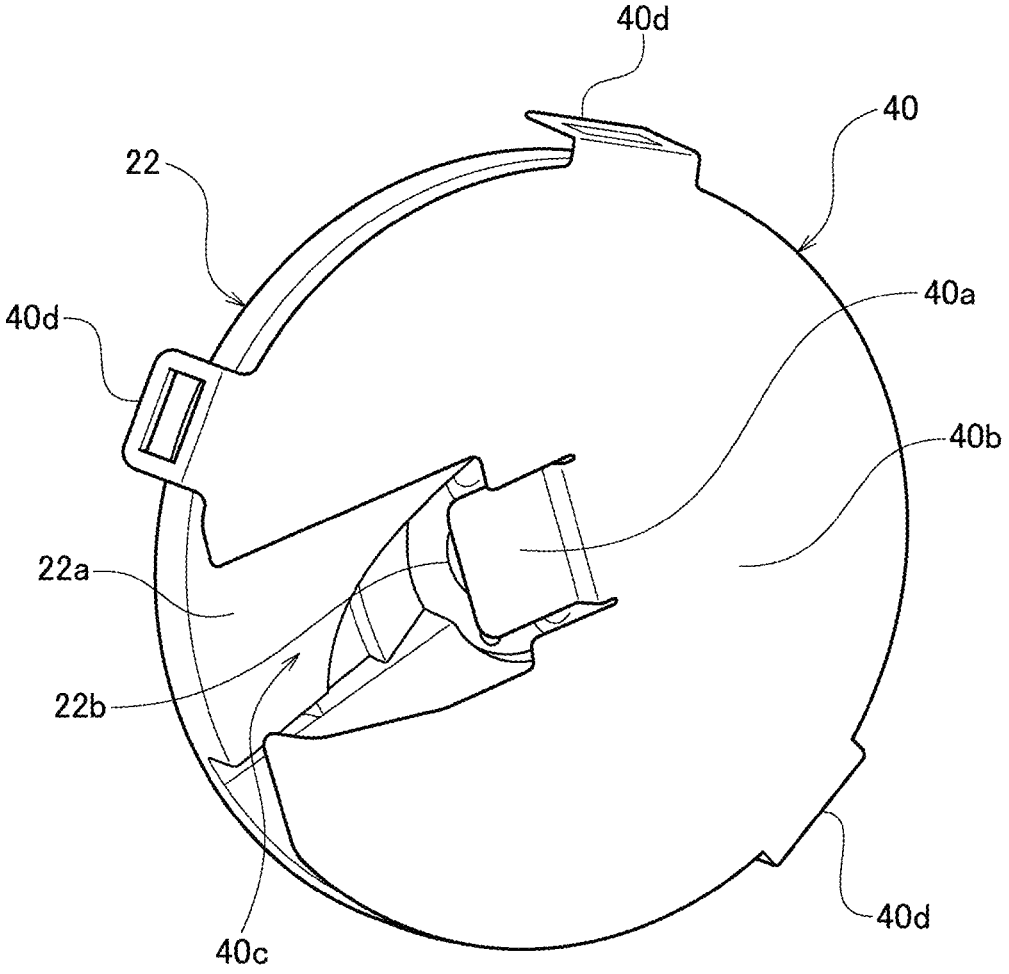
FIG. 20 is a perspective view showing a state in which the rotating reflector is covered by the shade according to the present embodiment.
Figure 21:
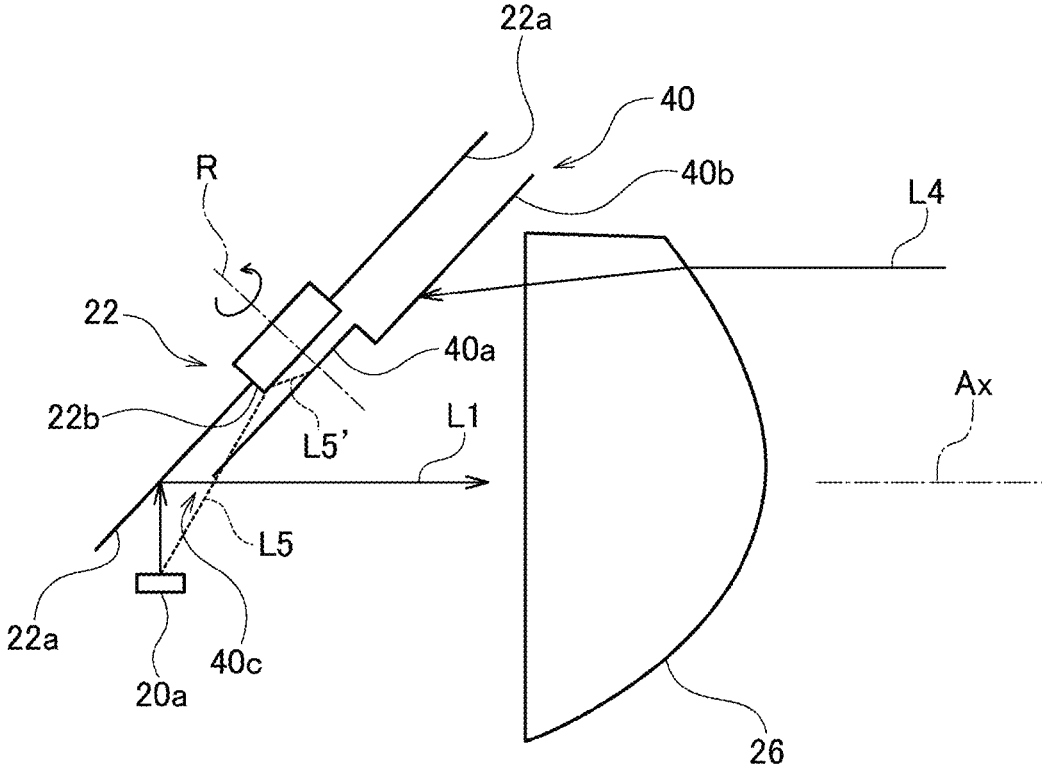
FIG. 21 is a schematic diagram for explaining the function of the shade employed in the optical unit according to the present embodiment.

FIG. 20 is a perspective diagram showing a state in which the rotating reflector is covered by the shade according to the present embodiment. FIG. 21 is a schematic diagram for explaining the function of the shade employed in the optical unit according to the present embodiment.

As shown in FIG. 21, the light L5 directly passing from the LED 20*a* toward the rotating portion 22*b* and the reflected light L5' reflected by the rotating portion 22*b* are not light controlled by being reflected by the blade 22*a* of the rotating reflector 22. Accordingly, if such light is projected frontward via the convex lens 26, in some cases, such light is irradiated to a region that differs from a desired light distribution pattern. This arrangement has the potential to cause glare.

In order to solve such a problem, the shade 40 according to the present embodiment includes the central shielding portion 40*a* configured to block the light L5 that passes toward the rotating portion 22*b*, which is a part of the light emitted from the LED 20*a*, and the reflected light L5' reflected by the rotating portion 22*b*, which is a part of the light emitted from the LED 20*a*. This arrangement prevents the light reflected by the rotating portion 22*b*, which is a part of the light emitted from the LED 20*a*, from entering the convex lens 26, thereby suppressing the occurrence of glare.

In contrast, if the entire face of the blade 22*a* is covered by the shade 40, the rotating reflector 22 is not able to provide its function. Accordingly, the shade 40 according to the present embodiment has the aperture portion 40*c* that allows the light L1 emitted from the LED 20*a* to pass toward the blade 22*a*, and to allow the light L1 reflected by the blade 22*a* to pass through. This arrangement is capable of suppressing the occurrence of a missing portion in the light distribution pattern and a reduction of the illuminance due to the shade 40 thus mounted.

Furthermore, the reflective face shielding portion 40*b* of the shade 40 is configured to block at least a part of the light that passes toward the blade 22*a* of the rotating reflector 22, which is a part of the external light L4 input to the convex lens 26 from the front side of the vehicle. This arrangement is capable of blocking the external light L4 that passes toward the rotating reflector 22 after it enters from the convex lens 26.

Figure 22:
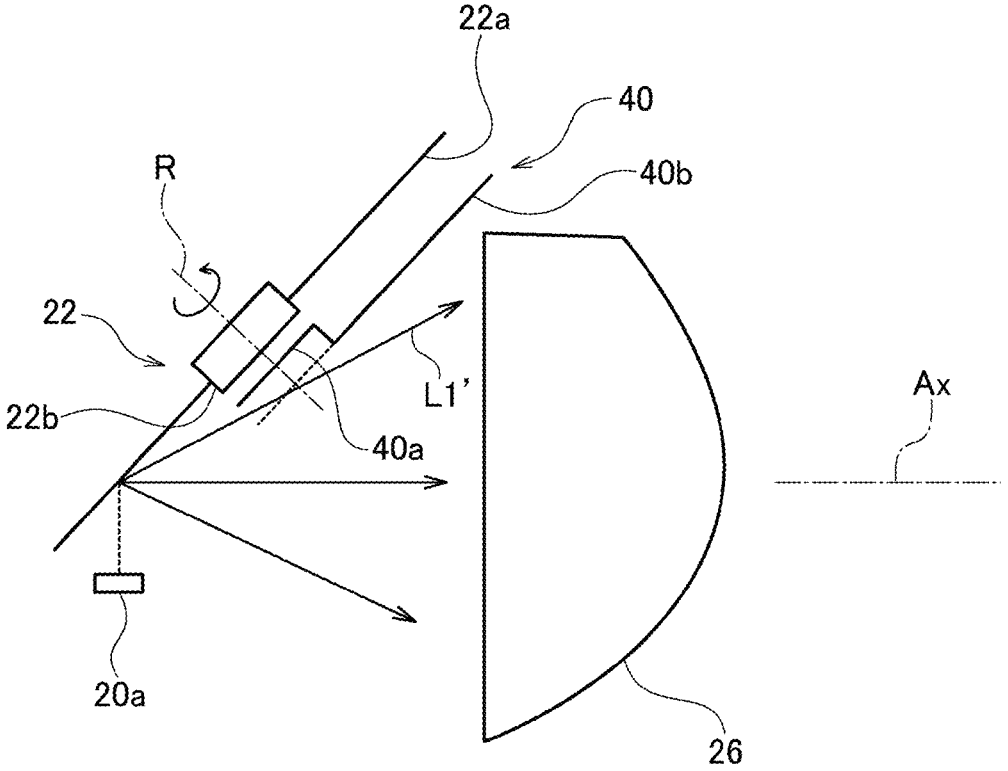
FIG. 22 is a schematic diagram for explaining the function of the central shielding portion of the shade employed in the optical unit according to the present embodiment.

FIG. 22 is a schematic diagram for explaining the function of the central shielding portion of the shade employed in the optical unit according to the present embodiment.

The shade 40 according to the present embodiment is configured as a plate-shaped member formed of the central shielding portion 40*a* and the reflective face shielding portion 40*b*, which are coupled with each other. The central shielding portion 40*a* is arranged above the rotating portion 22*b*. Furthermore, the central shielding portion 40*a* has a recess that is recessed toward the rotating portion 22*b* side as compared with the reflective face shielding portion 40*b*. This arrangement is capable of reducing blocking by the shielding portion 40*a* of a part of the light L1' that has been reflected by the blade 22*a* of the rotating reflector 22.

Furthermore, the central shielding portion 40*a* shown in FIG. 22 has a length that is shorter than that of the central shielding portion 40*a* shown in FIG. 21. This is why, in a case in which the central shielding portion 40*a* is designed to have a long length, i.e., in a case in which the aperture portion 40*c* is designed to have a narrow width, this leads to a problem in that a part of the light L1' reflected by the blade 22*a* is blocked.

It should be noted that the rotating portion 22*b* according to the present embodiment is formed of the same material as that of the blade 22*a*. Alternatively, the rotating portion 22*b* is subjected to the same surface processing as the blade 22*a*. Examples of such surface processing include reflective film processing by vapor deposition or plating, surface texturing, blasting, etc. With this, there is not necessarily a difference in the material or surface processing between the rotating portion 22*b* and the blade 22*a*. This allows the manufacturing cost for the rotating reflector 22 to be reduced.

Description has been made above regarding the present invention with reference to the aforementioned embodiments. However, the present invention is by no means intended to be restricted to the aforementioned embodiments. Also, various modifications may be made by appropriately combining or replacing components of the aforementioned embodiments, which are also encompassed within the scope of the present invention. Also, various modifications may be made by modifying a combination of the embodiments, or otherwise modifying the order of the processing steps, or various designs may be modified, based on the knowledge of those skilled in this art, which are also encompassed within the scope of the present invention.

APPENDIX

It is to be noted that Embodiments described above may be expressed by the items described hereinafter.

Item 1. An optical unit comprising:

a light source;

a rotating reflector structured to be rotated in a single direction with a rotational axis as a center of rotation while reflecting light emitted from the light source; and a projector lens structured to project the light reflected by the rotating reflector in a light irradiation direction, wherein the rotating reflector is provided with a reflective face around a rotational axis thereof such that light emitted from the light source and reflected by the rotating reflector while rotating is projected by means of the projector lens so as to form a desired light distribution pattern, wherein the reflective face has a blade shape structure that is twisted such that an angle defined between the rotational axis and the reflective face is changed along a circumferential direction with the rotational axis as a center, and wherein the rotational axis is arranged with a slope with respect to a front-rear direction of the optical unit and with a shift with respect to a plane including a focal point of the projector lens.

Item 2. The optical unit according to item 1, wherein the rotational axis is arranged such that it is shifted in an upper-lower direction with respect to a plane including a focal point of the projector lens.

Item 3. The optical unit according to item 1, wherein the rotational axis is provided approximately parallel to a scanning plane formed by continuously connecting a trajectory of an irradiation beam scanned by rotation.

Item 4. The optical unit according to item 1, wherein, in a front-rear direction of the optical unit, the light source is arranged between a front end and a rear end of a region where the rotating reflector is arranged, and wherein, in a direction that is orthogonal to the front-rear direction of the optical unit, the light source is arranged between both ends of a region where the projector lens and the rotating reflector are arranged.

Item 5. The optical unit according to item 1, wherein, in a direction that is orthogonal to a front-rear direction of the optical unit, the light source is arranged within a region where a rotating reflector is arranged.

What is claimed is:

1. An optical unit comprising:

a light source;

a rotating reflector structured to be rotated in a single direction with a rotational axis as a center of rotation while reflecting light emitted from the light source; and a projector lens structured to project the light reflected by the rotating reflector in a light irradiation direction, wherein the projector lens includes a first lens region structured to define a first focal plane and a second lens region structured to define a second focal plane that differs from the first focal plane, and wherein the light source is arranged such that, when the rotating reflector is set to a first rotational position, a virtual image position of the light source is positioned in the vicinity of the first focal plane, and such that, when the rotating reflector is set to a second rotational position, a virtual image position of the light source is positioned in the vicinity of the second focal plane.

2. The optical unit according to claim 1, wherein the first lens region includes a center of the projector lens, and wherein the second lens region is positioned on an outer side of the first lens region.

3. The optical unit according to claim 2, wherein the rotating reflector is provided with a reflective face such that light emitted from the light source and reflected by the rotating reflector while rotating forms a desired light distribution pattern, and wherein the projector lens is structured such that the light that has passed through the first lens region is irradiated to a central portion of the light distribution pattern, and such that the light that has passed through the second lens region is irradiated to an end portion of the light distribution pattern.

4. The optical unit according to claim 3, wherein the rotating reflector is structured such that a blade that functions as the reflective face is provided around a rotational axis, and wherein the blade has a twisted structure in which an angle defined between an optical axis and the reflective face is changed along a circumferential direction thereof with the rotational axis as a center.

5. The optical unit according to claim 1, wherein the projector lens is structured to have an input face and an output face determined such that there is no crossing within the projector lens between light beams reflected by the rotating reflector.

6. A reflective face determining method for determining a reflective face of a rotating reflector structured to be rotated in a single direction with a rotational axis as a center of rotation while reflecting light emitted from a light source, the reflective face determining method comprising:

setting an optical face of a projector lens that is capable of providing a desired light distribution pattern in a front side;

setting a region of a virtual light source regarded as emitting light to be projected as the light distribution pattern;

setting an angle of the rotational axis of the rotating reflector with respect to a straight line that passes through a focal point of the projector lens;

setting a position of the light source;

setting a range of a reflection angle of the rotating reflector such that a virtual image position of the light source matches the region of the virtual light source; and setting a plurality of divided cross-sectional faces in the range of the reflection angle, and rotationally extending and connecting the plurality of divided cross-sectional faces with the rotational axis as a center, so as to set a reflective face of the rotating reflector.

7. The reflective face determining method according to claim 6, wherein the plurality of divided cross-sectional faces are set so as to provide reflection angles at an equal pitch.

8. The reflective face determining method according to claim 6, wherein the reflection angle is set in a range from ±5° to ±10° with respect to a plane that is orthogonal to the rotational axis.

9. The reflective face determining method according to claim 6, wherein the reflective face is set such that light emitted from the light source and reflected by the rotating reflective face forms a desired light distribution pattern.

10. The reflective face determining method according to claim 6, wherein the rotating reflector is structured such that a blade that functions as the reflective face is provided around a rotational axis, and wherein the blade has a twisted structure such that an angle defined between the rotational axis and the reflective face is changed along a circumferential direction with the rotational axis as a center.

11. An optical unit comprising:

a rotating reflector having a rotating portion, and a reflective face provided around the rotating portion and structured to reflect light emitted from a light source while rotating so as to form a light distribution pattern; and a shade having a central shielding portion structured to shield light that passes toward the rotating portion from among the light emitted from the light source, or to shield light reflected by the rotating portion from among the light emitted from the light source.

12. The optical unit according to claim 11, wherein the shade has an aperture portion that allows light emitted from the light source to pass toward the reflective face, and that allows light reflected by the reflective face to pass through.

13. The optical unit according to claim 11, further comprising a projector lens structured to project reflected light reflected by the rotating reflector toward a front side of a vehicle, wherein the shade further comprises a reflective face shielding portion structured to shield at least a part of light that passes toward the reflective face of the rotating reflector from among external light input to the projector lens from the front side of the vehicle.

14. The optical unit according to claim 13, wherein the shade is structured as a plate-shaped member having a structure in which the central shielding portion and the reflective face shielding portion are coupled, and wherein the central shielding portion is arranged above the rotating portion such that it is recessed toward the rotating portion as compared with the reflective face shielding portion.

15. The optical unit according to claim 11, wherein the rotating portion is formed of the same material as that of the reflective face, or is formed with the same surface processing as the reflective face.

* * * * *